US008815318B2

(12) United States Patent
Zoss et al.

(10) Patent No.: US 8,815,318 B2
(45) Date of Patent: Aug. 26, 2014

(54) PACKAGES FOR DISPENSING LIQUID AND DRY FOOD

(75) Inventors: Robert A. Zoss, Plymouth, MN (US); Linda Baggio, Hopkins, MN (US); Jeffrey Enz, Minneapolis, MN (US); Michael J. Engstrom, Minneapolis, MN (US); Bryan Scholtes, Fridley, MN (US)

(73) Assignee: General Mills, Inc., Minneapolis, MN (US)

( * ) Notice: Subject to any disclaimer, the term of this patent is extended or adjusted under 35 U.S.C. 154(b) by 841 days.

(21) Appl. No.: 12/456,014

(22) Filed: Jun. 10, 2009

(65) Prior Publication Data

US 2010/0003379 A1 Jan. 7, 2010

Related U.S. Application Data

(63) Continuation-in-part of application No. 12/384,709, filed on Apr. 8, 2009, now Pat. No. 8,485,378.

(60) Provisional application No. 61/131,508, filed on Jun. 10, 2008.

(51) Int. Cl.
*B65D 81/32* (2006.01)
*B65D 51/24* (2006.01)

(52) U.S. Cl.
CPC ..... *B65D 81/3211* (2013.01); *B65D 51/247* (2013.01); *B65D 81/3222* (2013.01)
USPC ..... 426/115; 426/120; 426/119; 426/112; 426/106; 426/394; 206/221; 206/219; 220/710; 220/703

(58) Field of Classification Search
CPC ..... B65D 81/32; B65D 81/3211; B65D 81/3205; B65D 81/3216; B65D 81/3222; B65D 2543/00046; B65D 2231/025; B65D 2205/02; A47G 19/02; Y10S 215/08; Y10S 215/902; A47J 31/06; A47J 43/27; A47J 1/2093
USPC ..... 426/115, 120, 130, 85, 106, 112, 394; 206/219–222, 514; 220/23.83, 23.86, 220/23.87, 23.91, 501, 4.27, 705, 710; 222/129, 189.07; 99/279, 304, 306, 99/316–323
See application file for complete search history.

(56) References Cited

U.S. PATENT DOCUMENTS 1,379,519 A * 5/1921 Bjornsen ..... 220/575
2,591,606 A * 4/1952 Reed ..... 99/316

(Continued)

FOREIGN PATENT DOCUMENTS

WO WO 02/064494 A1 8/2002
WO WO 02/066339 A1 8/2002
WO WO 2007/002623 A2 7/2007

OTHER PUBLICATIONS

Harriet carter, "*Cereal-on-the-Go*," http://www.harrietcarter.com/index.cfm/fuseaction/product.detail/categoryID/C64C0157-E9A3-473A-A54B-8320E49D5237/productID/48C530B8-3BC1-4ACF-B37A-F136574422B8.

(Continued)

*Primary Examiner* — Drew Becker
*Assistant Examiner* — Luana Z Long
(74) *Attorney, Agent, or Firm* — John L. Crimmins; Michaele A. Hakamaki

(57) ABSTRACT

Describe are food packages having features such as multiple containers in a single package and multiple pieces for a package; the packages can contain multiple food products including (for example) cereal and milk, for consumption together in a convenient manner.

7 Claims, 23 Drawing Sheets

(56) References Cited

U.S. PATENT DOCUMENTS

| | | | | | |
|---|---|---|---|---|---|
| 2,646,200 | A | * | 7/1953 | Atkins | 229/125.04 |
| 3,288,344 | A | * | 11/1966 | Woollen et al. | 229/103.1 |
| 4,069,940 | A | * | 1/1978 | Naimoli | 220/575 |
| 4,558,804 | A | | 12/1985 | Keck | |
| 4,779,722 | A | * | 10/1988 | Hall | 206/221 |
| 4,986,433 | A | * | 1/1991 | Davis | 220/23.8 |
| 5,168,140 | A | * | 12/1992 | Welker | 219/689 |
| 5,328,051 | A | | 7/1994 | Potter et al. | |
| 5,588,561 | A | | 12/1996 | Ness | |
| 5,676,244 | A | | 10/1997 | Green et al. | |
| 5,676,275 | A | | 10/1997 | Khattar | |
| 5,706,980 | A | | 1/1998 | Dickerson | |
| 5,727,679 | A | | 3/1998 | Newarski | |
| 5,746,113 | A | * | 5/1998 | Ko | 99/323 |
| 5,753,289 | A | | 5/1998 | Ness | |
| 5,913,964 | A | * | 6/1999 | Melton | 99/322 |
| 5,952,028 | A | * | 9/1999 | Lesser | 426/433 |
| 6,196,406 | B1 | | 3/2001 | Ennis | |
| 6,221,402 | B1 | | 4/2001 | Itoh et al. | |
| 6,248,363 | B1 | | 6/2001 | Patel et al. | |
| 6,254,907 | B1 | | 7/2001 | Galomb | |
| 6,264,068 | B1 | * | 7/2001 | Ours et al. | 222/129 |
| 6,528,105 | B1 | | 3/2003 | Gerhart et al. | |
| 6,641,854 | B2 | | 11/2003 | Gerhart et al. | |
| 6,913,777 | B2 | | 7/2005 | Rebhorn et al. | |
| 7,063,229 | B2 | | 6/2006 | Westerhof et al. | |
| 7,217,434 | B1 | * | 5/2007 | Loh et al. | 426/115 |
| 7,815,073 | B1 | * | 10/2010 | Fairchild | 222/129 |
| 8,485,378 | B2 | * | 7/2013 | Zoss et al. | 220/23.86 |
| 8,574,647 | B1 | * | 11/2013 | Gunderson | 426/115 |
| 2002/0110622 | A1 | | 8/2002 | Lloyd et al. | |
| 2002/0192338 | A1 | * | 12/2002 | Ness et al. | 426/119 |
| 2003/0157224 | A1 | * | 8/2003 | Westerhof et al. | 426/394 |
| 2005/0172832 | A1 | | 8/2005 | Groenke | |
| 2006/0086755 | A1 | | 4/2006 | Roth et al. | |
| 2006/0086756 | A1 | | 4/2006 | Roth et al. | |
| 2006/0108022 | A1 | | 5/2006 | Carter et al. | |
| 2007/0221513 | A1 | | 9/2007 | Taylor-Sharp et al. | |
| 2009/0004336 | A1 | * | 1/2009 | La et al. | 426/85 |
| 2010/0001007 | A1 | * | 1/2010 | Ferraro | 220/574 |

OTHER PUBLICATIONS

Skopis, *Combination Container Kits, "Lets get it together"*.

* cited by examiner

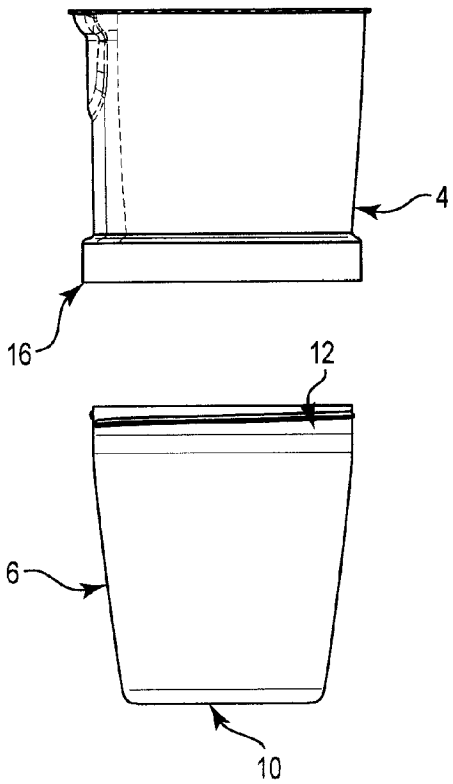
Fig. 1D
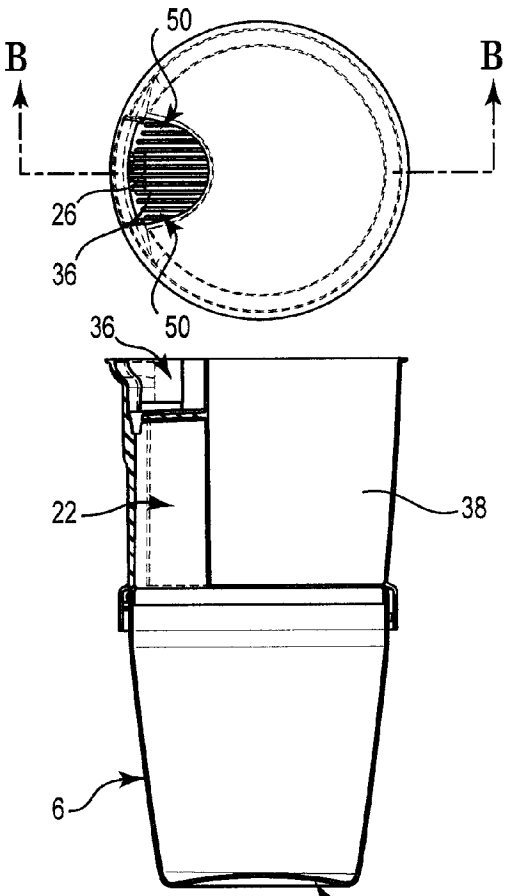
B-B

A-A

A-A

PACKAGES FOR DISPENSING LIQUID AND DRY FOOD

PRIORITY

The present non-provisional patent Application claims benefit from U.S. Provisional Patent Application having Ser. No. 61/131,508, filed on Jun. 10, 2008, by Engstrom et al., and titled PACKAGES FOR DISPENSING LIQUID AND DRY FOOD, and is a continuation-in-part application from U.S. Ser. No. 12/384,709, filed Apr. 8, 2009, now U.S. Pat. No. 8,485,378 by Zoss et al., and titled PACKAGES FOR DISPENSING LIQUID AND DRY FOOD, wherein the entireties of these patent applications are incorporated herein by reference.

FIELD OF THE INVENTION

The invention relates to food packages having features such as multiple containers in a single package and multiple pieces for a package; the packages can contain multiple food products including cereal and milk, but not necessarily cereal, for consumption together in a convenient manner.

BACKGROUND

Breakfast is considered the most important meal of the day, but traditional "at home" breakfast eating occasions are declining. Mornings are rushed so consumers need on-the-go (e.g., portable) breakfast product solutions. A significant reason for skipping breakfast is not having the time to eat at home. A portable breakfast allows a person to take a serving of breakfast along, away from the home, and eat the breakfast at their morning destination or on the way to that destination.

One of the most common breakfast foods is dry cereal eaten with milk. By conventional methods, a dry cereal is placed in a bowl or other container and milk is poured over the cereal. The consumer consumes the milk and cereal together from the bowl using a spoon. This conventional mode of cereal consumption requires the user to remain stationary to consume the cereal from the bowl and is not an activity that can be safely performed while the consumer is mobile, such as by walking, riding, or driving a vehicle. Also, the serving of cereal is not portable for consumption upon arrival at a destination. Understood limitations of this basic mode of consuming cereal are that the combination of the bowl of cereal and milk is not mobile, and, therefore, the consumer must place the cereal and milk into the bowl in one location (normally a kitchen or eating area), and to also eat the cereal using a spoon in that same location.

To make breakfast a more convenient meal, manufacturers have offered breakfast bars, breakfast sandwiches, and other breakfast foods that can be consumed with a single hand and without preventing the person eating the food from moving from the location at which the food was prepared or purchased. There have also been attempts to construct a container that stores cereal and milk separately and allows the cereal and milk to be removed from a storage location (e.g., kitchen) or place of purchase, to be consumed at a later time or different location. Some of these containers are designed to allow the consumer to eat cereal and milk from a container using a single hand, optionally without having to be at a stationary position, but optionally while moving with the container while consuming the contents. These containers may provide mobility to the cereal eater, but past package designs have suffered from various shortcomings. For instance, past designs may not allow for dispensing a desired amount of milk relative to cereal, may not allow for controlled delivery of cereal, or may allow cereal and milk to contact each other and become soggy.

Various products have been developed to contain cereal and milk separately and then allow the cereal and milk to be mixed when consumed using a container that can be manipulated by one hand. Examples of such product configurations are illustrated and described at U.S. Pat. Nos. 5,588,561, 5,753,289, 6,528,105, and others. Such products show a single container that may hold cereal and milk in separate compartments of a single container, in a manner to allow the cereal and milk to be dispensed from the single container.

Continuing need exists for a cereal container that can contain milk and cereal together in a single package that allows a user to dispense cereal and milk using one hand.

SUMMARY

The following description relates to food packages and containers that can be useful to hold a food (e.g., dry cereal) and a liquid (e.g., milk), in separate containers, and to dispense the particulate food and liquid as a combined mixture. Packages having multiple containers that can contain cereal and milk are also described in Applicant's copending U.S. Provisional Patent Application Ser. No. 61/131,508, filed Jun. 10, 2008, titled PACKAGES FOR DISPENSING LIQUID AND DRY FOOD, and U.S. Ser. No. 12/384,709, filed Apr. 8, 2009, by Zoss et al., titled PACKAGES FOR DISPENSING LIQUID AND DRY FOOD, the entireties of which are incorporated herein by reference. Packages specifically described and illustrated herein include features also described in those copending application.

The packages are particularly useful for storing and allowing consumption of breakfast in the form of dry ("ready-to-eat") breakfast cereal, with milk. Breakfast is considered the most important meal of the day, but traditional "at home" breakfast eating occasions are declining. Mornings are rushed so consumers need on-the-go (e.g., portable) breakfast product solutions. A significant reason for skipping breakfast is not having the time to eat at home. A portable breakfast allows a person to take a serving of breakfast along, away from the home, and eat the breakfast at their morning destination or on the way to that destination.

One of the most common breakfast foods is dry cereal eaten with milk. By conventional methods, a dry cereal is placed in a bowl or other container and milk is poured over the cereal. The consumer consumes the milk and cereal together from the bowl using a spoon. This conventional mode of cereal consumption requires the user to remain stationary to consume the cereal from the bowl and is not an activity that can be safely performed while the consumer is mobile, such as by walking, riding, or driving a vehicle. Also, the serving of cereal is not portable, for consumption upon arrival at a destination. Understood limitations of this basic mode of consuming cereal are that the combination of the bowl of cereal and milk is not mobile, and, therefore, the consumer must place the cereal and milk into the bowl in one location (normally a kitchen or eating area), and to also eat the cereal using a spoon in that same location.

To make breakfast a more convenient meal, manufacturers have offered breakfast bars, breakfast sandwiches, and other breakfast foods that can be consumed with a single hand and without preventing the person eating the food from moving from the location at which the food was prepared or purchased. There have also been attempts to construct a container that stores cereal and milk separately and allows the cereal and milk to be removed from a storage location (e.g., kitchen)

or place of purchase, to be consumed at a later time or different location. Some of these containers are designed to allow the consumer to eat cereal and milk from a container using a single hand, optionally without having to be at a stationary position, but optionally while moving with the container while consuming the contents. These containers may provide mobility to the cereal eater, but past package designs have suffered from various shortcomings. For instance, past designs may not allow for dispensing a desired amount of milk relative to cereal, may not allow for controlled delivery of cereal, or may allow cereal and milk to contact each other and become soggy.

The following description includes designs for packages and containers for separately storing milk and cereal. Embodiments of packages allow the user to store or transport milk and cereal together and, at their convenience, and combine the two for consumption. Certain package designs fit into consumers' busy lifestyles by enabling a consumer to eat their favorite cereals and milk while on the go, or to transport a single serving of cereal and milk to a location away from a point of purchase or storage (e.g., kitchen). Embodiments of product designs allow for cereal consumption with little to no preparation, primarily requiring the consumer to grab a combined cereal and milk package, and go; according to different embodiments a consumer may eat upon arriving at their destination, or along the way. Certain embodiments provide better performance relative to past designs for packages that include cereal and milk.

Two general approaches to meet consumer needs are described: 1. A portable package for cereal and milk that allows a user to bring a serving of cereal and milk to a destination, combine the cereal and milk after arriving at their destination, and then eat the mixture with a spoon, and 2. A package that allows a consumer to eat a mixture of cereal and milk with just a single hand, while in motion. Both concepts can either be a complete offering supplying cereal and shelf stable milk, or may in the form of a package that contains cereal and no milk, but permits the user to supply their own serving of milk. In either approach the milk and cereal remain separate until the consumer is ready to consume the cereal and milk together.

While the description exemplifies milk and dry cereal as being contained in and dispensed from described packages, other forms of food will also be useful with packages as described. Certain package designs allow for a particulate food and the liquid to be stored, transported, and optionally sold or delivered, together, then consumed being dispensed from or removed from the package as a mixture. The packages are particularly useful for storing and allowing consumption of breakfast in the form of dry ("ready-to-eat") breakfast cereal, with milk.

Exemplary described packages allow a consumer to eat a mixture of cereal and milk with just a single hand, while in motion. Exemplary products can either be a complete offering supplying cereal and shelf stable milk, or may in the form of a package that contains cereal and no milk, but permits the user to supply their own serving of milk. For example, because the packages can contain cereal and milk separately, a package that contains cereal can be prepared, stored, shipped, and sold separately from a package that contains milk; the package that contains cereal can be combined with a separate milk product at any point of storage, preparation, shipping, inventorying, or commercial or retail sale, such as by a consumer who has purchased a cereal product and a milk product separately. In either approach the milk and cereal remain separate until the consumer is ready to consume the cereal and milk together.

Any of the packages and containers described, in combination with any one or more other features, can include specific features such as a "dose" control feature, a "sieve" feature, or features that involve two or more (multiple) pieces assembled to produce a multi-container package. Individual "pieces" can be produced by injection molding, thermoforming, or other methods, and may include one or more of a "cover" piece, a "container" piece (e.g., a "cereal container" piece), and a "lower container" piece. Pieces can be completely separate, or partially separate or separable, such as by being connected at a hinge. Other packages can involve the same features but a multi-piece construction or with construction as fewer pieces, e.g., a "cover piece" can be combined with a "container" piece or an "upper container" piece.

Various versions of multi-piece packages ("dose" control-type or "sieve" type packages, see below) can include a "cover piece" that is not merely flat but that is three-dimensional. Advantageously, a three-dimensional cover can improve the ease with which a consumer can dispense cereal and milk from a package.

A "dose" control feature can be a feature that controls amounts of cereal and milk that dispense from a package when tipped. This feature can involve structural features such as a holding stage, a milk channel, or combinations of these.

A "sieve" feature can be a feature that allows passage of liquid between an interior space of a package that contains cereal and a space below the interior package.

In one aspect the invention relates to a multi-container package. The package includes: a lower container that includes: a lower container interior space defined by a bottom and sidewalls, and an opening in communication with the lower container interior space, at an upper region of the lower container, and an upper container connected to the lower container, located above the lower container. An upper container includes: an upper container interior space defined by an upper container bottom and upper container sidewalls, the upper container bottom extending between the upper container sidewalls at a lower region of the upper container sidewalls, and a holding stage defined by a shelf and sidewalls, in fluid communication with the lower container interior space through a channel, and in fluid communication with the upper container interior space.

In another aspect the invention relates to a package that includes an interior space defined by a bottom, an upper opening, and sidewalls extending between the bottom and the upper opening, an aperture at the bottom and having a valve, and a liquid-tight engagement element at a lower region of the package.

In another aspect the invention relates to a multi-container package that includes a lower container. The lower container includes a lower container interior space defined by a bottom and sidewalls, and an opening in communication with the lower container interior space, at an upper region of the lower container. An upper container is connected to the lower container, located above the lower container, the upper container including an upper container interior space defined by a bottom and sidewalls, the bottom extending between the sidewalls at a lower region of the sidewalls, the upper container interior space being in fluid communication with the lower container interior space. The upper container includes a cover extending between locations of a cover perimeter connected to the upper container sidewalls, the cover having a three-dimensional form that defines a coverspace below the cover and above the upper container interior space. The upper container includes a holding stage defined at a bottom by a stage and at sides by sidewalls, including a front sidewall and a backwall, in fluid communication with the lower container interior space through a milk channel, and in fluid communication with the upper container interior space through a passage defined at least in part the backwall and the cover, the passage having a height dimension of at least 0.5 centimeters.

In another aspect the invention relates to a multi-container package, the package including multiple pieces including: a lower container piece that includes a lower container volume defined by a bottom and sidewalls, the bottom extending between the sidewalls at a lower region of the sidewalls, an opening at an upper region of the lower container, and a lower container upper-container engagement at an upper region of the lower container; an upper container piece that includes an upper container volume defined by a bottom and sidewalls, the bottom extending between the sidewalls at a lower region of the sidewalls, an opening at an upper region of the sidewalls, an upper container lower-container-engagement that engages the lower container upper-container engagement in a liquid-tight manner, and an upper container upper engagement, the upper container interior space being in fluid communication with the lower container interior space; and a cover piece that includes a cover extending between locations of a cover perimeter, a cover piece engagement that engages the upper container upper engagement in a liquid-tight manner, the cover having a three-dimensional form that defines a coverspace below the cover and above the upper container interior space.

In another aspect the invention relates to a package that includes: an interior space defined by a bottom, a cover comprising a cover opening, and sidewalls extending between the bottom and the cover, the bottom extending between the sidewalls at a lower region of the sidewalls; an aperture formed in the bottom, and a liquid-tight engagement element, the engagement element comprising a snap-fit engagement element selected from the group consisting of: a detent, a shoulder, a beveled shoulder; a rounded ridge, a groove, a concave groove, and combinations of these.

In yet another aspect the invention relates to a package that includes: an interior space defined by a bottom and sidewalls, the bottom extending between the sidewalls at a lower region of the sidewalls, the bottom comprising an aperture; a cover; a holding stage defined in part by a stage and sidewalls, including a front sidewall and a backwall; and a milk channel located below the holding stage; wherein the holding stage is in fluid communication with the milk channel, and is in fluid communication with the upper container interior space through a passage between the backwall and the cover, the passage having a height dimension of at least 0.5 centimeters.

In another aspect the invention relates to a multi-container package that includes an upper container and a lower container, wherein: the upper container includes an opening at a lower region; the lower container includes an opening at an upper region; the upper region of the lower container engages the lower region of the upper container by a liquid-tight engagement such that the opening at the lower region of the upper container aligns with the opening at the upper region of the lower container; and the opening of the lower container is separated from the opening of the upper container by a seal.

In another aspect the invention relates to a kit that includes separate milk and cereal containers, the kit including: a milk container containing milk; a cereal container containing cereal and comprising a bottom and sidewalls, and a top opening, the cereal container containing cereal, optionally an eating implement, optionally a napkin; the cereal container being sealed around the top opening by a removable layer.

BRIEF DESCRIPTION OF THE FIGURES

FIG. 1D includes top, side, and side cut-away views of a package as described.

DETAILED DESCRIPTION

Figure 1A:
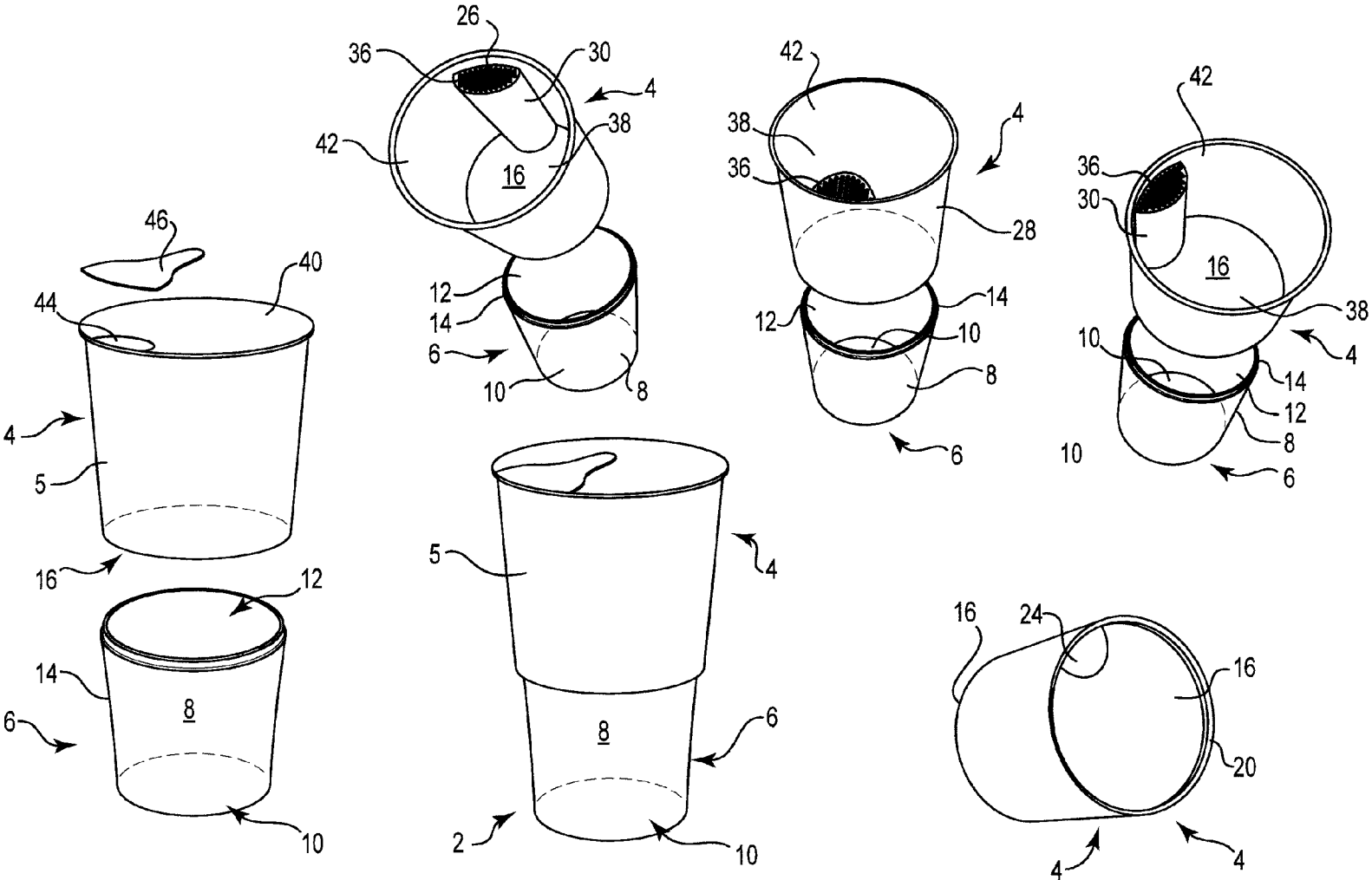
FIG. 1A illustrates various views of a package as described.
Figure 1B:
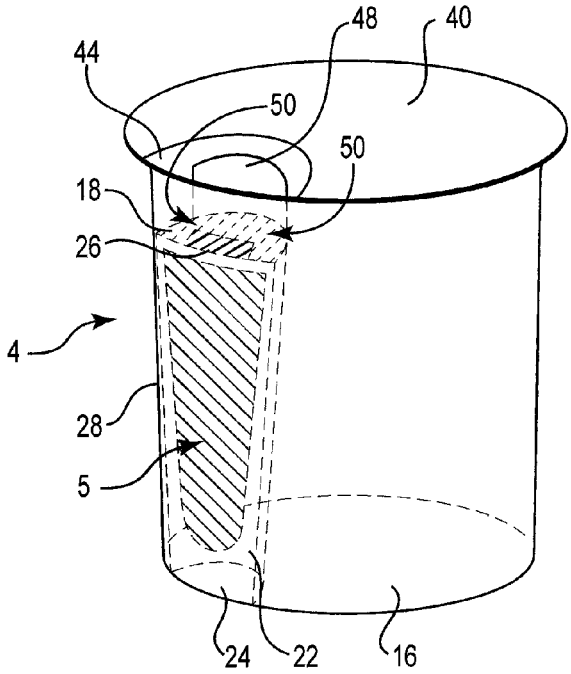
FIG. 1B is a side perspective view of a package as described.
Figure 1C:
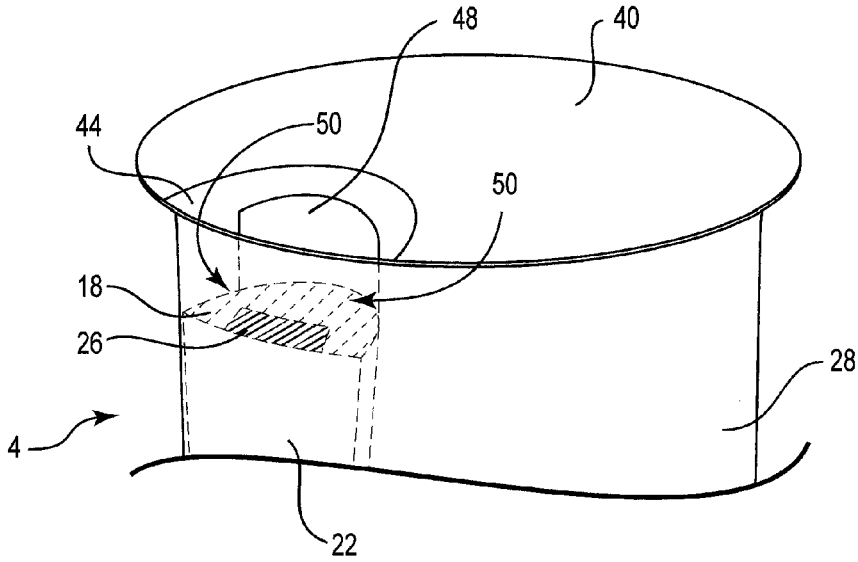
FIG. 1C is a side perspective view of a package as described.

Below are brief descriptions and sketches of exemplary designs of packages for storing, dispensing, or storing and dispensing dry cereal and milk for consumption.

Following are descriptions and sketches of exemplary designs of packages for storing, dispensing, or storing and dispensing dry cereal and milk for consumption.

Embodiment of packages as described include separate containers for separately containing milk and cereal or other combinations of foods. Exemplary packages can allow a consumer to dispense the foods, e.g., milk and cereal, together as a mixed stream through a single opening directly into the consumer's mouth.

In certain embodiments, cereal and milk are stored separately in two containers of the package, an "upper" container (sometimes otherwise simply referred to as a "container" or as a "cereal" container) that is above a "lower" container, and a lower container that is below the upper container.

Certain embodiments of packages involve a "dose" control and a cereal holding stage. Upon tipping the package to dispense the cereal and milk, dry cereal enters a cereal holding stage that is within the package, milk passes through a milk channel and also enters the cereal holding stage to contact the cereal, the milk and cereal contact and mix within the cereal holding stage, and the cereal and milk (after coming into contact with each other within the package) are delivered from the package to the consumer. As used herein, the terms "above" and "below" are used in a conventional manner to indicate a location of one feature of a package (above or below, i.e., higher than or lower than) relative to another feature, when the package is held vertically, unless otherwise indicated.

In general, such exemplary packages can include a lower container for milk and a separate upper container for dry cereal. Use of the package is simple and intuitive. In embodiments where the two containers are sold together and engaged, the lower container is disengaged from its attachment at the bottom of the upper container. Optionally either milk is added to the lower container (if the package is sold without milk contained in the lower container) or if milk is already contained in the lower container a seal such as a foil (present to cover and seal the milk in the lower container) may be removed from the top opening of the lower container. In embodiments where the two containers are sold as separate products—a milk product and a cereal product—the milk product, including the lower container, can be opened and attached to the bottom of the cereal product, which contains the upper container. The lower container can be connected or re-connected to the bottom of the upper container. The engagement between the lower container and the upper container may be any liquid-tight engagement. Examples include threaded configurations, inter-locking or snap-fit surfaces such as a lip, flange, etc., at opposing engagement surfaces of the lower container and the upper container, or similar mechanical liquid-tight engagements.

In certain embodiments, the upper container can be opened by peeling a tab, unscrewing a cap, or opening a seal, etc., to allow access to an interior space such as a cereal holding stage, which in turn accesses locations of milk and dry cereal. The product can be used to deliver cereal and milk in the same manner as a beverage dispenser (e.g., a can or bottle such as used for carbonated beverages) by dispensing a mixture of cereal and milk by tipping the container to cause the contents to empty from the top of the container into a user's mouth. (As used herein, a package is considered to be tipped "forward" by tipping a front side of a top of the package in a direction toward the user, with the front side being a side of the package that dispenses cereal and milk and that is generally held toward the user.) According to embodiments of the described packages, a combined mixture of dry cereal and milk, in desired amounts or combinations of amounts, can be delivered directly to a user's mouth.

In certain embodiments, milk flows through a milk channel extending from the lower container and through the upper container but not in contact with the dry cereal while in the milk channel. A "milk channel" is a continuous path extending from the lower container interior space to a location at an upper region of the upper container, optionally at a front location at the upper container, optionally to a milk port (e.g., an aperture or other opening that accesses the milk channel) at a holding stage. Milk can flow from the lower container, through the milk channel, to the milk port, when the package is tipped toward the user. The milk is delivered from a milk port located in the upper container, for as long as the package is in the tipped position. The rate of the flow can be controlled by selecting factors including the size of the opening (milk port) through which milk is delivered at the top of the upper container and the size of the milk channel.

According to exemplary embodiments of described packages that include a "holding stage" feature, an amount, rate, or amount and rate at which dry cereal is delivered from a package can optionally be affected or controlled to result in a desired volume ("dose") of cereal delivered each time the package is tipped. A "holding stage" is a space located at an upper container, optionally near the a cover opening, optionally and preferably at a mid region or at an upper region of an upper container, most preferably at an upper region, such as at an upper half or upper third (by vertical height when the package is held vertically) of the upper container; alternately a holding stage can be at a location that is lower, such as at a middle region of the upper container between a top and a bottom. A holding stage can be defined at least partially by a "stage" or "shelf" at a bottom of the holding stage, and sidewalls. The holding stage sidewalls can include a front sidewall and a backwall, the backwall separating the holding stage (to the front of the backwall) and the upper container interior space (to the rear of the backwall). The top of the holding stage can be directly accessible to a "coverspace" or to a cover opening so that when the package is tipped toward the user an amount of cereal present in the holding stage can flow out of the cover opening. According to exemplary embodiments a cereal passage can be include a channel or opening between a cereal stage backwall and a cover, e.g., above an upper surface of a backwall and below a cover, optionally including space within a coverspace. Other cereal passages are on through openings at sides of the holding stage.

Control of the amount or rate of cereal delivery through the cover opening may be affected by factors generally including the size (volume) of a cereal holding stage near the cover opening, the size of a cereal passage through which cereal passes from the upper container interior space into the cereal holding stage, sizes of cereal pieces, and whether or not a cereal bridge forms at a cereal passage during flow of cereal when the package is tipped and held in a tipped orientation. The cereal holding stage can be a feature of the upper container, e.g., located at an upper region of the upper container, near the top of the upper container, near the upper container interior space and in communication with the upper container interior space, near the cover opening and also at the top of (above) the milk channel, optionally and preferably at or near the "front" of the package.

In certain embodiments a package can be designed to deliver approximately the same amount or "dose" of cereal each time a user tips the package to deliver cereal and milk; when the package is tipped, an amount of cereal becomes delivered from the upper container interior space, through a cereal passage, to the cereal holding stage (i.e., becomes pre-staged), and this amount of cereal becomes the next to be delivered the next time the package is tipped; optionally, cereal delivery stops or is interrupted upon formation of a cereal bridge, which is an amount of cereal that clogs the cereal passage to create a stoppage of cereal flowing through the cereal passage.

The amount, rate, or amount and rate of cereal delivery can also be affected by the size and density of the dry cereal pieces. The size of cereal pieces can be selected to cause a desired flow or flow rate through passages for delivery. The size of cereal pieces may also be selected to create a cereal "bridge" to interrupt cereal flow even while the package remains tipped. For example, a package can be designed to result in the formation of a cereal bridge to stop cereal flow through the cereal passage after a desired amount (one "dose") of cereal is dispensed. A cereal bridge may form during dispensing of the cereal when the package is tipped, at a cereal passage or at another opening through which cereal pieces flow. The size of a cereal passage or other opening that results in formation of a cereal bridge depends on the size of cereal particulates (pieces). Larger cereal particulates require a larger opening to allow a desired dose delivery followed by formation of a cereal bridge. An opening size may be selected to allow a desired or predetermined volume of cereal that is approximately one heaping teaspoon (alternately, a volume equal to the volume of the cereal holding stage) to be dispensed to the user with each tip of the package, then for a cereal bridge to form and stop the flow of cereal.

Exemplary width and height dimensions of a cereal passage can be sufficient to allow passage of a desired type of cereal such as a flake, a puffed cereal piece, etc., which may be relatively round (Trix™), square (Cinnamon Toast Crunch™), puffed and circular, (Cheerios™), etc. An example of a range of height dimensions of a cereal passage located above a backwall, defined as the distance from a top of a holding stage backwall to a closest location of a cover, can be from 5 millimeters to 25 millimeters, e.g., from 12 to 23 millimeters. An example of a range of width dimensions of a cereal passage located above a backwall, defined as a distance along a top of a holding stage backwall (which may be straight or arcuate), can be from 10 to 35 millimeters, e.g. from 15 to 30 millimeters.

A container that includes an interior space designed to contain cereal (often referred to herein as the "upper container") can be designed to engage another container, e.g., a "lower" container, at a lower region of the upper container, in a liquid-tight manner. The liquid-tight engagement can allow the upper container to be placed above the lower container in a manner for the upper container to be in fluid communication with the lower container (e.g., a lower container interior space) through one or multiple apertures, and for the combination of engaged containers to deliver milk and cereal through a single cover opening at an upper region of the package.

Such an engagement element may be any useful mechanical or adhesive-type engagement element that engages a corresponding element of the lower container. An engagement element can be located generally on a surface that extends around a perimeter of surface of the container, which may be an external surface or an internal surface. An exemplary engagement can include threads that allow a threaded engagement between two containers. Other exemplary engagements may involve one or more snap-fit mechanisms such as one or more of: a mechanical detent, a shoulder, a beveled shoulder having a variable (beveled) diameter increasing toward a bottom or top of a package or container piece to allow an opposing structure to snap-fit onto the beveled shoulder; a generally planar rounded ridge, groove, concave groove, ring, or annular ring; combinations of any of these; or any other type of molded or snap-fit structure that can be used to produce a liquid-tight engagement.

Certain embodiments as described include a "holding stage" and related features designed to deliver a desired amount of cereal (e.g., a "dose") and a flow of milk. An overall design of a dosing mechanism for delivery of a desired pre-determined amount of cereal, optionally interrupted by formation of a cereal bridge, can be based on features that include selection of the size of the opening of a cereal passage leading from an upper container interior space to a cereal holding stage, a size of a holding stage, and the size, shape, and density of cereal pieces. The mechanism is based on the tendency of particulates (cereal pieces) to bridge across an opening if their size is smaller than the opening, but still large in relation to the opening, and if the flow rate is sufficiently rapid. Formation of a cereal bridge can be used in the present application as a cereal delivery control mechanism in this package design. The control mechanism can be made to occur when an average diameter of cereal pieces is from about 25 to about 95, e.g., from about 75 to 95 percent of a dimension (e.g., a height dimension) of an opening; if the opening is not square or round the relevant dimension is the smallest dimension of the opening.

According to various embodiments, a volume of cereal that can be delivered as a single "dose" from a package, based on a user tipping the package a single time, contained in a holding stage, for pre-staged delivery, can be in the range of about 0.25 to 4 cubic inches. This can be accomplished by package features that include a holding stage, cover opening, and cereal passage, dimensioned to accommodate this dosage. An exemplary volume of a holding stage can be in a range of 0.25 to 3 cubic inches; an exemplary area dimension of a cereal passage can be in a range of 0.5 to 2 square inches; and an exemplary dimension of a cover opening can be in a range of 0.5 to 2 square inches, optionally round or generally round with a diameter of from to 0.7 to 1.2 inches.

Related to the volume of a holding stage is a cross sectional area of a holding stage, meaning for example dimensions of a "stage" defining a lower surface of a holding stage, or a parallel cross section. The vertical dimension (height, from top to bottom) may matter less when designing a dose volume, because of the manner by which cereal flows into the holding stage, optionally including bridging. While a shape of a stage or cross sectional area of a holding stage may be varied, e.g., oval, circular, square, or rectangular, an exemplary side-to-side diameter or width can be in the range from 0.5 to 2 inches; exemplary front-to-back "depth" can be in the range from 0.25 to 1 inch. While top-to-bottom height can vary, an exemplary area can be from 0.25 to 3 cubic inches.

"Holding Stage Embodiment"

FIGS. 1A, 1B, 1C, and 1D show a "Holding Stage Embodiment," which is a one-handed design for separately containing milk and cereal in a manner that allows a consumer to dispense the milk and cereal together as a mixed stream through a single opening directly into the consumer's mouth.

The cereal and milk are stored separately in two containers of the package. Upon tipping the package to dispense the cereal and milk, the dry cereal enters a cereal holding stage that is within the package, milk passes through a milk channel and also enters the cereal holding stage to contact the cereal, the milk and cereal contact and mix within the cereal holding stage, and the cereal and milk (after coming into contact with each other within the package) are delivered from the package to the consumer.

In general, the package includes a lower container for milk and a separate upper container for dry cereal. Use of the package is simple and intuitive. The lower container is removed from its attachment at the bottom of the upper container. Optionally either milk is added to the lower container (if the package is sold without milk contained in the lower container) or if milk is already contained in the lower container a seal such as a foil (present to cover and seal the milk in the lower container) may be removed from the top opening of the lower container. The lower container can be re-connected to the bottom of the upper container. The upper container can be opened by peeling a tab or seal to allow access to a cereal holding stage, which in turn accesses the separate locations of the milk and the dry cereal. The product can be used to deliver cereal and milk in the same manner as a beverage dispenser (e.g., a can such as used for carbonated beverages) by dispensing a mixture of cereal and milk by tipping the container to cause the contents to empty from the top of the container into a user's mouth. (As used herein, a package is considered to be tipped "forward" by tipping a front side of a top of the package in a direction toward the user, with the front side being a side of the package that dispenses cereal and milk.) According to embodiments of the described packages, a combined mixture of dry cereal and milk, in desired amounts or combinations of amounts, can be delivered directly to a user's mouth.

An optional feature of a Holding Stage Embodiment package is the capability to deliver milk through a restricted opening or milk port. Milk will flow through a milk channel extending from the lower container and through the upper container but not in contact with the dry cereal while in the milk channel. The milk is delivered from a milk port located in the upper container, when the package is in the tipped position.

An amount and rate at which dry cereal is delivered from the package can optionally be affected or controlled to result in a desired volume ("dose") of cereal delivered each time the package is tipped. Control of the amount and rate of cereal delivery may be affected by factors generally including the size (volume) of a cereal holding stage near the upper cover opening, the size of side passages (see below) through which cereal passes into the cereal holding stage, and whether or not a cereal bridge forms at a side passage during flow of cereal. The cereal holding stage is located within the upper container and near the top of the upper container in the internal space of the upper container and in communication with the upper container internal space, near the upper cover opening and also at the top of (above) the milk channel. In certain embodiments, a package can be designed to deliver approximately the same amount or "dose" of cereal each time a user tips the package to deliver cereal and milk; when the package is tipped, an amount of cereal becomes delivered from the upper container interior space to the cereal holding stage (i.e., becomes pre-staged), and this amount of cereal becomes the next to be delivered the next time the package is tipped; optionally, cereal delivery stops or is interrupted upon formation of a cereal bridge.

The amount and rate of cereal delivery can also be affected by the size and density of the dry cereal pieces. The size of cereal pieces can be selected to cause a desired flow or flow rate through passages for delivery. The size of cereal pieces may also be selected to create a cereal "bridge" to interrupt cereal flow even while the package remains tipped. For example, a package can be designed to result in the formation of a cereal bridge to stop cereal flow after a desired amount (one "dose") of cereal is dispensed. A cereal bridge may form during dispensing of the cereal when the package is tipped, such as at a side passage (see below) or at another opening through which cereal pieces flow. The size of a side passage or other opening that results in formation of a cereal bridge depends on the size of cereal particulates (pieces). Larger cereal particulates require a larger opening to allow a desired dose delivery followed by formation of a cereal bridge. An opening size may be selected to allow a volume of cereal that is approximately one heaping teaspoon (alternately, a volume equal to the volume of the cereal holding stage) to be dispensed to the user with each tip of the package, then for a cereal bridge to form and stop the flow of cereal.

An overall design of a "dose" mechanism for delivery of a desired pre-determined amount of cereal, interrupted by formation of a cereal bridge, can be based on features that include selection of the size of the opening of a side channel leading to a cereal holding stage, and the size, shape, and density of cereal pieces. The mechanism is based on the tendency of particulates (cereal pieces) to bridge across an opening if their size is smaller than the opening, but still large in relation to the opening, and if the flow rate is sufficiently rapid. Formation of a cereal bridge can be used in the present application as a cereal delivery control mechanism in this package design. The control mechanism can be made to occur when an average diameter of cereal pieces is from about 25 to about 95, e.g., from about 75 to 95 percent of a dimension of an opening; if the opening is not square or round the relevant dimension is the smallest dimension of the opening.

Certain features related to the use of the cereal package of FIGS. 1A, 1B, 1C, and 1D include the following. Cereal and milk are contained in separate containers until dispensed, e.g., until a user dispenses a desired amount of cereal and milk directly into the mouth of the user by tipping the container. The package can be sold (e.g., prepared, stored, transported, and packaged) with milk contained in the lower container, or alternately with the lower container empty. If the lower container is sold without milk, a consumer can add milk by detaching the lower container, placing milk in the lower container, and reattaching the lower container to the upper container. The cereal and milk are consumed by manipulating the package by tipping the package to deliver contents directly to the user's mouth in a manner similar to drinking from a cup or a soda can. Cereal and milk are delivered from their respective containers within the package, to a cereal holding stage near the opening at the top of the package. The cereal holding stage is located at an upper end of a milk channel so the cereal and milk are mixed within the cereal holding stage, just prior to delivery from the package. An amount of cereal that is delivered by tipping the package is a volume similar to the volume of the cereal holding stage. The amount, or "dose" delivered by a single tip of the package can optionally be interrupted by formation of a cereal bridge at the side passages. An increased amount of cereal may be delivered by optional manipulation (shaking) of the package, if desired.

Referring to FIG. 1A, a combined milk and cereal package 2 includes two separate containers, upper container 4 and a lower container 6. Lower container 6 includes lower container sidewalls 8, lower container bottom 10, and lower container top opening 12, and can be engaged and sealed against upper container bottom 16 of upper container 4. As illustrated, the sealing engagement between upper container bottom 16 and lower container top opening 12 of lower container 6 is a threaded engagement that produces a water-tight seal; the engagement is between lower threads 14 of lower container 6 and upper threads 20 of upper container 4 (this engagement may alternately be a press-fit engagement, a snap-fit engagement, or any other mechanical or adhesive fitted engagement). Upper cover 40 covers upper container opening 42, and includes upper cover opening 44, which can in turn be covered by opening cover 46. Upper cover 40 and opening cover 46 can be made of plastic, paper, cardboard, foil, etc., with adhesive placed at one or more surfaces to secure a perimeter of upper cover 40 to a lip or edge of upper container 4, and to secure opening cover 46 to upper cover 40 to cover and close (e.g., seal) upper cover opening 42.

Lower container 6 is designed to hold milk during use. Optionally, milk can be contained in lower container 6 during transport or storage, in which instance the milk may be sealed in a separate package (e.g., a plastic bag or paper or cardboard carton or container) or a seal may be placed across opening 12 to seal the milk for refrigerated or ambient temperature storage.

Upper container 4 includes various features that may allow for improved delivery of cereal and milk relative to earlier products designed to store and deliver milk together with dry cereal. Generally, interior space 38 of upper container 4 functions to contain dry cereal during use. Upper container 4 is defined at different portions by bottom 16, upper container sidewalls 28, and upper container top opening 42. A front of the upper container includes optional flat portion 5 that may assist in holding or aligning the package for tipping and delivery of cereal and milk.

Additional features of upper container 4 include milk channel 22 that extends from lower milk channel opening 24 at bottom 16, to milk port 26. Milk channel 22 allows milk to flow from lower container 6, through milk channel 22, and be delivered to cereal holding stage 36 to be combined with dry cereal and delivered from upper container 4 to the mouth of a consumer by tilting cereal package 2. Milk channel 22, as shown, e.g., at FIG. 1A, extends from bottom 16, starting at lower milk channel opening 24, vertically along upper container sidewall 28, to milk port 26 at shelf 18, and is further defined by internal milk channel wall 30 (wall 30 is illustrated to be rounded in cross-section, but may alternately be angular or linear). Shelf 18 extends horizontally relative to sidewall 28 and milk channel wall 30. As illustrated, milk channel 22 does not extend completely to the top of sidewall 28 but ends at shelf 18 (which defines the bottom of cereal holding stage 36). Interior space 38 of upper container 4 is defined in part by bottom 16, sidewalls 28, and internal milk channel wall 30.

At the top of milk channel 22 and within interior space 38 of upper container 4, so as to be accessible to cereal contained in upper container 4, is cereal holding stage 36. Cereal holding stage 36 is generally a space located above stage 18, within upper container 4, at the top of milk channel 22, also defined on a front side by sidewall 28, partially on a rear side by wall extension 48 and partially on one or more side by side passages 50. In the illustrated embodiment, wall extension (48) need not extend all the way up to contact upper cover 40, but can be sufficiently close to prevent flow of cereal pieces over the wall, e.g., less than within the average diameter of cereal pieces. Cereal holding stage 36 is accessible through upper covering opening 44, through which cereal and milk can be dispensed by tipping container 2, after cereal and milk are contacted with each other at cereal holding stage 36. Cereal holding stage 36 also is connected to interior space 38 in a manner to allow cereal to be transferred from interior space 38, into cereal holding stage 36, by manipulating cereal package 2, then further dispensed from package 2 at upper cover opening 44 by tipping package 2. As illustrated, side passages 50 are located laterally from wall extension 48, between edges of wall extension 48 and a front side of upper container sidewall 28.

Side passages 50 are sized to allow movement of cereal pieces from interior space 38 into cereal holding stage 36. Optionally, side passages are sized to allow free movement of cereal pieces into holding stage 36 for a desired amount of time, or for a desired amount of cereal, followed by formation of a cereal bridge at one or both side passages, to interrupt or stop further flow of cereal through side passages 50. The cereal bridge can be shaken loose, if desired, by the user, to deliver more cereal.

When the package 2 is transferred back to a vertical position from the tipped position used for dispensing, any amount of cereal that is in the cereal holding stage may remain there for delivery when the package is tipped the next time. Any milk that might remain in the cereal holding stage will be passed back through milk port 26 and return through milk channel 22 to lower container 6; re-separating the milk and cereal prevents the cereal from becoming soggy while being held at the cereal holding stage.

During use, when package 2 is tipped forward by a user in a manner to cause upper cover opening to be located below the contents of package 2, and toward the user's mouth, milk flows from lower container 6 through milk channel 22, through milk port 26 of shelf 18, to enter cereal staging space 36. Cereal enters cereal holding stage 36 from interior space 38 through side passages 50. The milk and cereal can be caused to flow into cereal holding stage 36 by user manipulation of package 2, especially by tilting the front part of package 2 (the side with milk channel 22 and cereal holding stage 36) forward. Upon continued tilting the mixture of milk and cereal is delivered from package 2 by passing through upper cover opening 44.

One optional feature of the design of cereal package 2 is improved control of the amount of cereal ("dose") delivered to a consumer upon each instance of tilting the package. A cereal dose size can be controlled by factors that include the size of cereal holding stage 36 and side passages 50, as well as the size and density of cereal pieces, and optionally but not necessarily by formation of a cereal bridge. A total amount of cereal delivered will be an amount contained in the cereal holding stage, and any additional amount that can be caused to flow from interior space 38 of upper container 4, through side passages 50, through cereal holding stage 36, and then out of upper cover opening 44, while package 2 is maintained in a tipped position. Optionally cereal size and the size of side passages 50 may result in formation of a cereal bridge at side passages 50, after a certain amount of cereal is delivered, which may interrupt cereal delivery; cereal flow may be restarted by manipulation of package 2 by shaking, rolling, or additional tipping, to disrupt a cereal bridge and encourage additional flow of cereal from interior space 38.

The size (e.g., volume) of a cereal holding stage can be any size that allows a desired flow of cereal into and through the holding stage; an exemplary volume can be, e.g., from 0.25 to 1 cubic inch. Exemplary dimensions of a shelf, which can correspond to the bottom dimensions of a cereal holding stage, can be a combination of a width and a depth each independently within the range from 0.5 to 1.5 inch. Exemplary height of a cereal holding stage can be in the range from 0.375 to 0.75 inch. Exemplary dimensions for each of the two side passages 50 can be, e.g., from about 0.1 to 0.5 square inch. Exemplary size and shape of cereal pieces used in combination with these dimensions of a cereal holding stage can be substantially round cereal pieces having average diameter in the range from 0.2 to 0.5 centimeter.

The amount of milk (i.e., milk flowrate) can be controlled by factors that include the size of milk port 26. An exemplary milk flow rate can be, e.g., from 3.5 to 16 milliliters per second, and an exemplary milk port can be sized to achieve this flowrate.

A feature of the Holding Stage Embodiment package is the ability to maintain dry cereal until right before use, i.e., until cereal and milk are dispensed together into cereal holding stage 36 and into a consumer's mouth. Keeping the cereal and milk separated during multiple dispensing (tipping) steps involving repetitive tipping can be a result of the milk being held back by the restricted size of milk port 26, which is only a portion of the size of shelf 18. When package 2 is set back to vertical from a tipped position, milk is directed back into lower container 6, through milk channel 22, to stay separated from the dry cereal in interior space 38 of upper container 4.

This keeps the cereal dry and crunchy. One result is that cereal is only briefly wetted or prehydrated with milk at the time that the cereal is mixed with the milk in the cereal holding stage, into a combined stream of milk and cereal, and upon at delivery from upper covering 44 directly to a user's mouth.

See also FIG. 1D, which shows a package having many of the same features as that of FIG. 1A.

"Hybrid A"

Figure 2A:
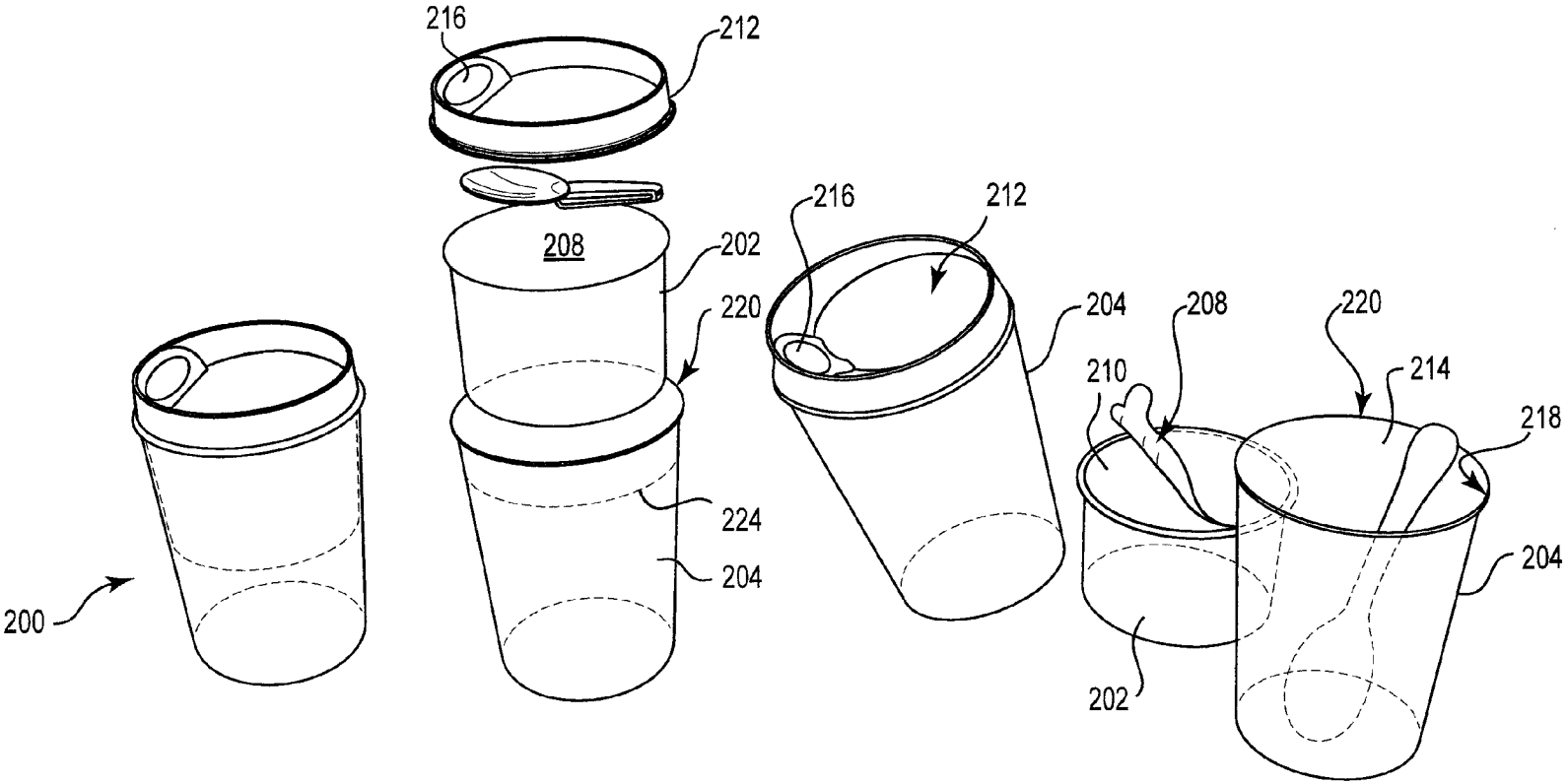
FIG. 2A illustrates various views of a package as described.
Figure 2B:
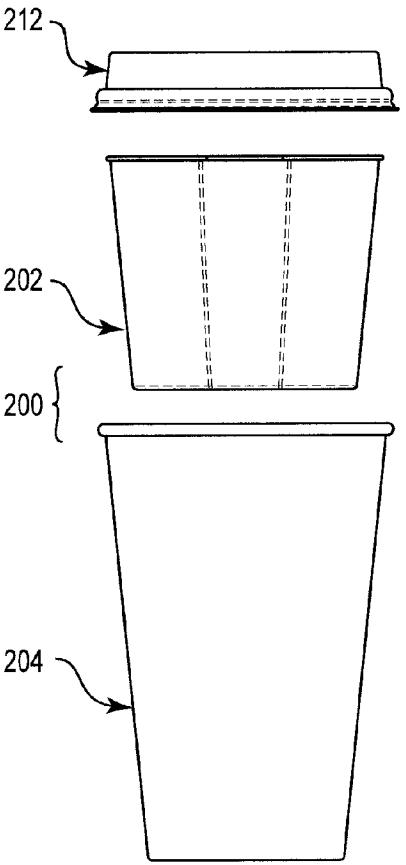
FIG. 2B includes top, side, and side cut-away views of a package as described.
Figure 2B:
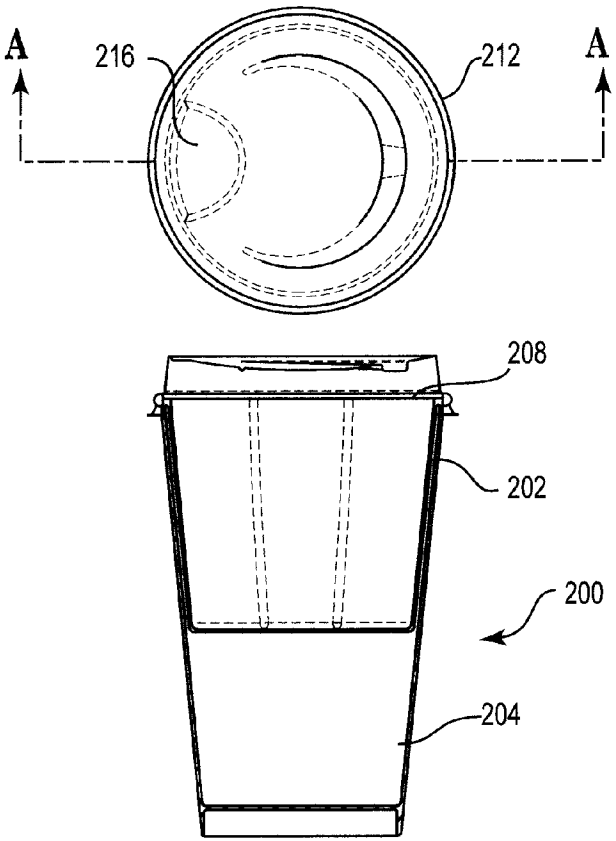

Another embodiment of a combined cereal and milk package is illustrated at FIGS. 2A and 2B, designated "Hybrid A." Features of Hybrid A can include a package that can be stored, transported, offered for sale, purchased, and used, while containing dry cereal and optionally milk for consumption in separate containers. The milk may be refrigerator-stable or shelf stable milk. The upper container can contain milk in a sealed upper container that nests into the lower container. The lower container supports the upper container, e.g., at an upper interior portion of the lower container, and additionally contains dry cereal at a lower portion of the lower container. A removable cover such as a foil, paper, or cardboard film or membrane covers and seals a top opening of the upper container to seal the upper container and the contained milk. A lid (e.g., plastic) covers the upper opening of the lower container, while the lower container contains the upper container. The lid can include a space for containing an eating implement (e.g., spoon), and optionally a napkin, between the lid and the upper container (at the top of the lower container), and can also include a lid opening that can be used to deliver cereal and milk to a user by tipping the container toward the user's mouth. During use, the upper container, containing milk, is removed from within the lower container, which contains dry cereal. A cover of the upper container is removed to expose milk in the upper container. The milk is poured into the lower container to produce a mixture of milk and cereal. The mixture of milk and cereal can be consumed in a conventional manner by use of a spoon to remove milk and cereal from the lower container, as with a conventional cereal bowl. Alternately, the lower container lid may be re-placed on the top opening of the lower container and a mixture of milk and cereal can be delivered to a user by a one-handed method through an opening in the lid by tipping the lower container toward the user's mouth.

Referring to FIG. 2A, package 200 includes upper container 202 and lower container 204. Upper container 202 can contain milk, which can be refrigerator stable or shelf stable, for storage, marketing, transport, and sale to a consumer. Upper container 202 includes top opening 214. Lower container 204, nested within upper container 202, can contain dry cereal for storage, marketing, transport, and sale to a consumer for consumption. Upper container 202 includes opening 210, covered and sealed by removable (e.g., peelable) cover 208 that may be made of plastic, paper, or foil, and that is secured lower container 204, e.g., by adhesive, to cover opening 210.

Top opening 214 of upper container 202 is covered by removable lid 212, which includes opening 216. During storage, upper container 202 can be held by lower container 204, i.e., nested, by an internal flange (224, as illustrated), shelf, or one or a plurality of pegs or other mechanical extensions extending from internal sidewall 218, or alternately may be held in place by a friction fit, in either instance, e.g., to sit at or below the upper edge 220 of the lower container 204.

See also FIG. 2B.

"Milk Container Adaptable Embodiment A"

Figure 3A:
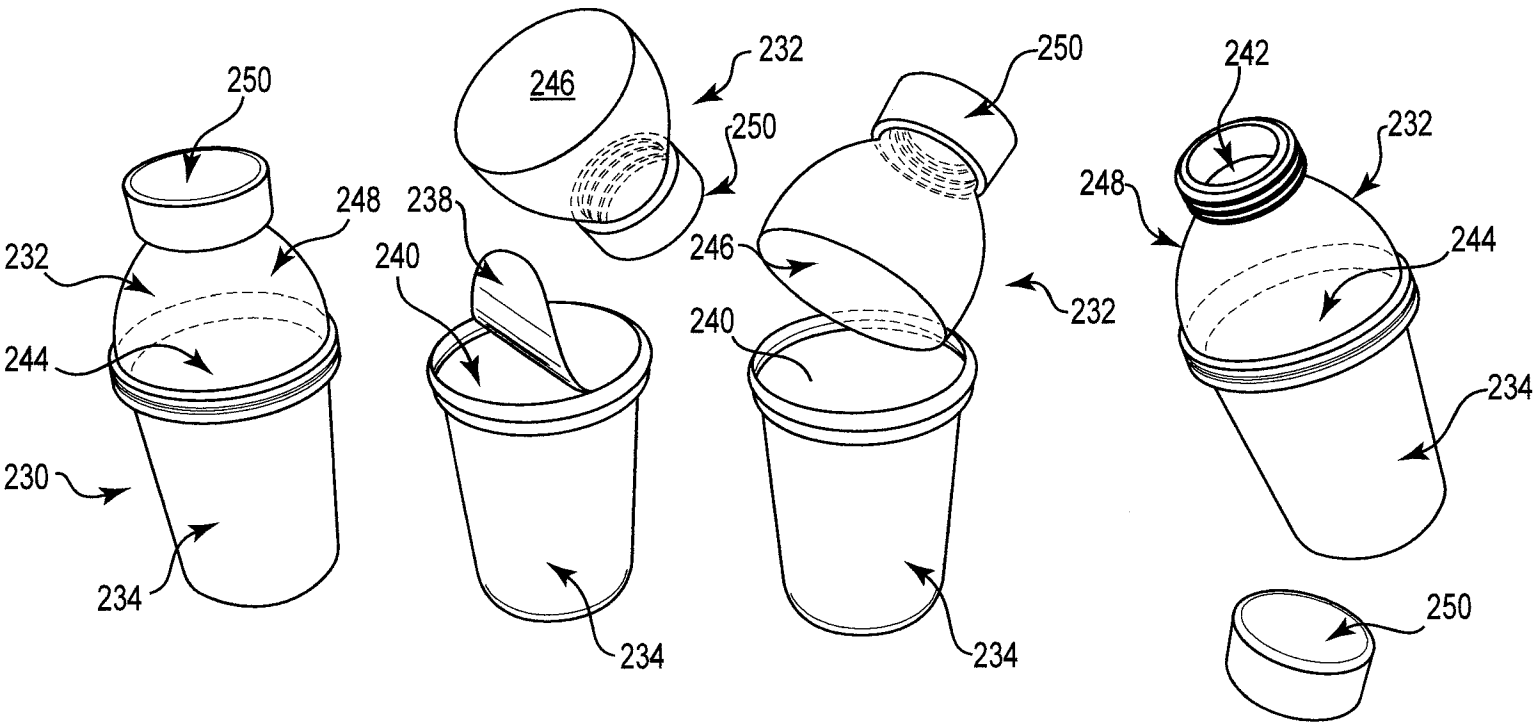
FIG. 3A illustrates various views of a package as described.
Figure 3B:
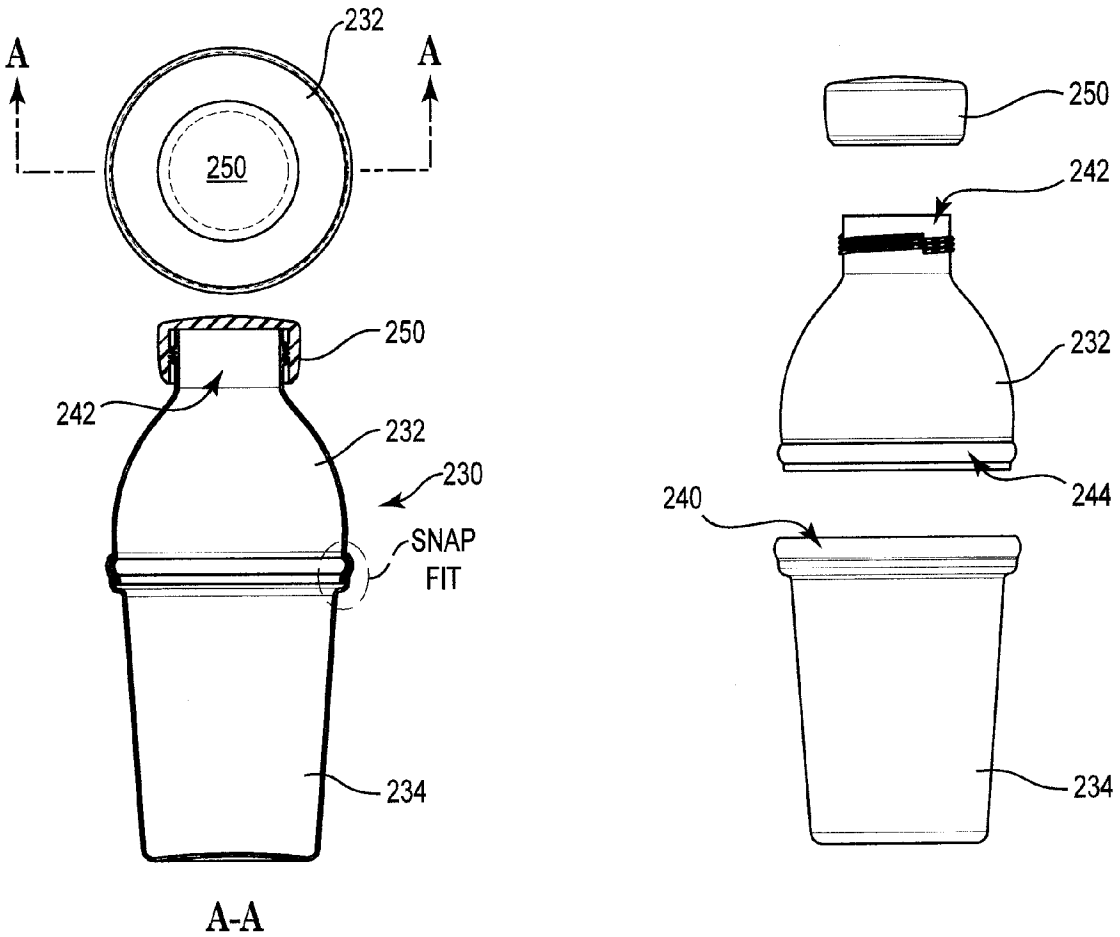
FIG. 3B includes top, side, and side cut-away views of a package as described.

Another embodiment of a combined cereal and milk package is illustrated at FIGS. 3A and 3B, designated "Milk Container Adaptable Embodiment A." Features of Milk Container Adaptable Embodiment A can include a package that can be stored and offered for sale while containing dry cereal and milk for consumption, each in a separate container. The milk may be refrigerator-stable or shelf stable milk.

During use, the upper container, containing dry cereal, is removed from the lower container (milk chug). A cover such as a foil, that covers and seals the lower container, is removed. Another cover can also cover the opening of the upper container, and can be, e.g., a dissolvable or breakable film or membrane that can be dissolved upon contact with water or liquid milk or broken by mechanical contact with dry cereal. When the upper container is re-secured to the lower container, the upper container cover continues to separate the milk in the lower container from the dry cereal in the upper container. The user shakes the package. The shaking may cause milk to contact the upper container cover and dissolve the cover or, alternately, the shaking may cause pieces of the dry cereal to mechanically contact and disrupt the upper container cover. After the upper container cover is dissolved or broken, cereal can pass from the upper container into the lower container to produce a mixture of cereal and milk in the lower container. A cap is located at an upper opening of the upper container. The user can consume the mixture of milk and cereal from the package by removing the cap from the upper opening of the upper container and tipping the package to deliver the cereal and milk directly to the consumer's mouth, from an opening in the upper container.

Referring to FIG. 3A, package 230 includes upper container 232 and lower container 234. Upper container 232 can contain dry cereal for storage, marketing, transport, and sale to a consumer. Upper container 232 includes upper opening 242, sidewalls 248, bottom opening 244, and cover 246, which can dissolve upon contact with liquid. Cap 250 is engaged (e.g., by threads) to close upper opening 242. Lower container 234 can contain milk, which can be refrigerated or shelf stable, for storage, marketing, transport, and sale to a consumer. Lower container 234 includes opening 240, covered and sealed by removable (e.g., peelable) cover 238 that may be made of plastic, paper, or foil, and that can be secured to opening 240 of lower container 234, e.g., by adhesive.

Opening 244 of upper container 232 engages opening 240 of lower container 234 in a sealing engagement that is tight to liquids, for example by a threaded engagement or a snap fit. Upper container 232 is shaped to have convex sidewalls (248) to facilitate flow of cereal, milk, and wetted cereal, along sidewalls 248 without the wetted cereal sticking to the sidewalls. The convex shape of the upper container is selected to maintain uninterrupted flow from the base to the mouth of the chamber, and does not include any sharp turns, ledges, etc. After milk and cereal are mixed in lower container 234, cap 250 can be removed by the user and a mixture of cereal and milk can be dispensed from opening 242, e.g., directly to a user's mouth.

In preferred embodiments an internal sidewall surface can be made of or coated to exhibit a of a low surface energy, e.g., a surface energy below about 50 dynes per centimeter, or less than 40 or 38 dynes per centimeter. Exemplary low surface area materials include polystyrene, polyvinylalcohol (PVA) polyethylene, polypropylene, and the like.

Figure 3C:
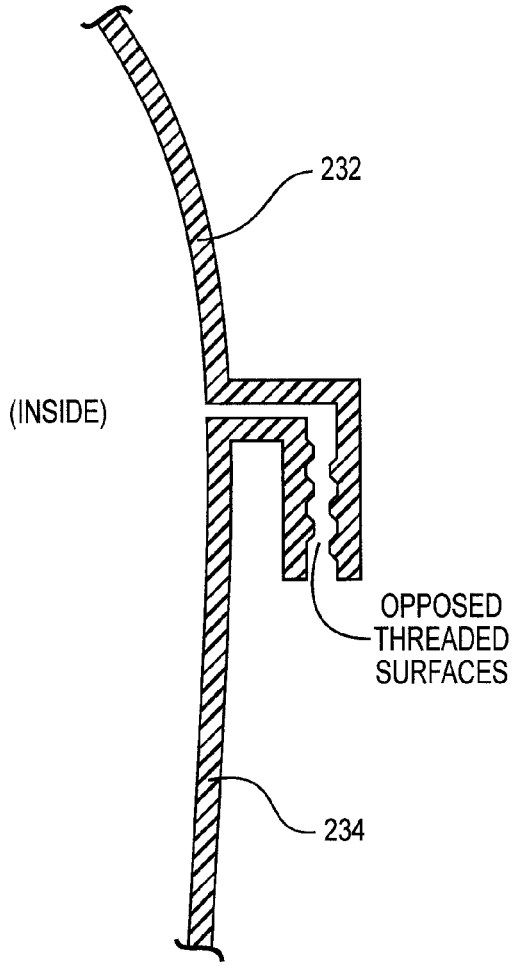
FIG. 3C is a side cut-away view of features of a package as described.

See also FIG. 3B. See also FIG. 3C, which shows threads used in place of a snap-fit for securing upper container 232 to lower container 234.

"Milk Container Adaptable Embodiment B"

Figure 4:
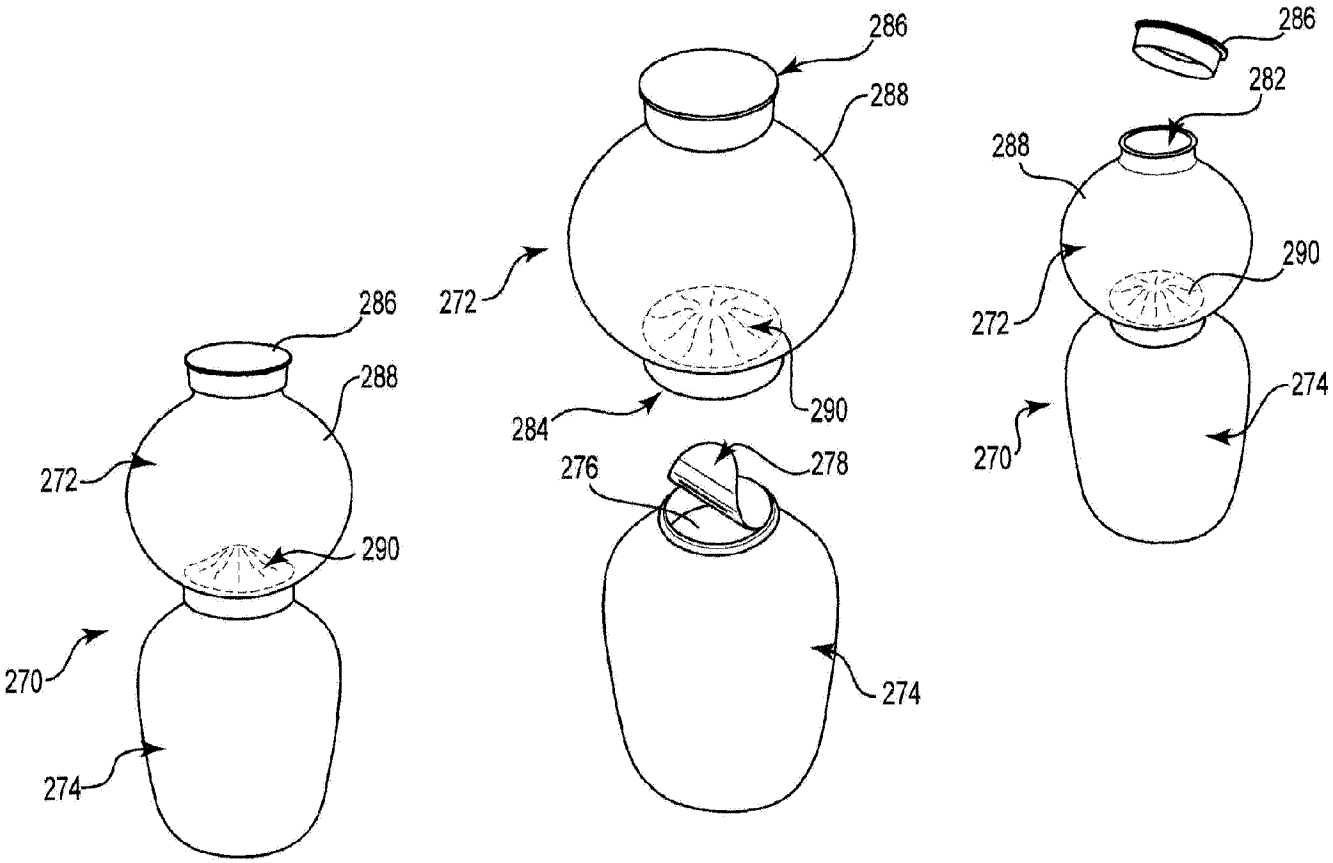
FIG. 4 illustrates various views of a package as described.

Another embodiment of a combined cereal and milk package is illustrated at FIG. 4, designated "Milk Container Adaptable Embodiment B." Features of Milk Container Adaptable Embodiment B can include a package that can be stored and offered for sale while containing dry cereal and milk for consumption, each in a separate container. The milk may be refrigerator-stable or shelf stable milk.

During use, the upper container, containing dry cereal, is removed from the lower container (milk chug). A cover such as a foil, that covers and seals an opening in the lower container, is removed. A valve can cover a lower opening of the upper container at a location where the lower opening attaches to an upper opening of the lower container; the valve can include a mechanical screen that allows milk to flow through the valve but does not allow passage of pieces of cereal. A removable cap can cover an upper opening of the upper container. After the cover is removed from the lower container opening, the upper container is replaced on the opening with the valve now separating the interior space of the upper container from the interior space of the lower container, at the location where the lower opening of the upper container is attached to the opening of the lower container. The valve allows milk to pass from the lower container into the upper container, when the package is tipped. The removable cap located at an upper opening of the upper container can be removed and the user can consume the mixture of milk and cereal from the package by tipping the package to deliver the cereal and milk directly to the consumer's mouth, from the opening in the upper container. The valve that separates the upper container from the lower container allows milk to pass back into the lower container but keeps cereal in the upper container to maintain separation of the milk and cereal, preventing the cereal from becoming soggy.

Referring to FIG. 4, package 270 includes upper container 272 and lower container 274. Upper container 272 can contain dry cereal for storage, marketing, transport, and sale to a consumer. Upper container 272 includes upper opening 282, sidewalls 288, bottom opening 284, cover 286 that covers upper opening 282, and valve 290 located within bottom opening 284. Cap 286 is engaged (e.g., by threads, a snap fit, or another mechanical or adhesive closure mechanism) to close and optionally seal upper opening 282. Lower container 274 includes opening 276, covered and sealed by removable (e.g., peelable) cover 278 that may be made of plastic, paper, or foil, and that can be secured to opening 276 of lower container 274, e.g., by adhesive. Lower container 274 can contain milk, which can be refrigerated or shelf stable, for storage, marketing, transport, and sale to a consumer.

Opening 284 of upper container 272 engages opening 276 of lower container 274 in a sealing engagement that is tight to liquids, for example by a threaded engagement or a snap fit. Upper container 272 is shaped to have convex sidewalls (288) to facilitate flow of cereal, milk, and wetted cereal, along sidewalls 288 without the wetted cereal sticking to the sidewalls. After cover 278 is removed and upper container 272 is re-attached to lower container 274, the package 270 contains milk in lower container 274 and dry cereal in upper container 272, with the milk and dry cereal being separated by valve 290, which has openings that allow milk to flow between the two containers but that do not allow cereal pieces to pass from upper container 272 into lower container 274. To dispense a mixture of cereal and milk, a user tips package 270 to cause milk to flow from lower container 274, through upper container 272 and out of opening 282, which also causes cereal to flow from upper container 272 out of opening 282; the mixture of cereal and milk can be dispensed from opening 282, e.g., directly to a user's mouth. The shape of the upper container is selected to maintain uninterrupted flow from the base to the mouth of the chamber. Sharp turns and ledges are undesirable.

"Milk Container Adaptable Embodiment C"

Figure 5A:
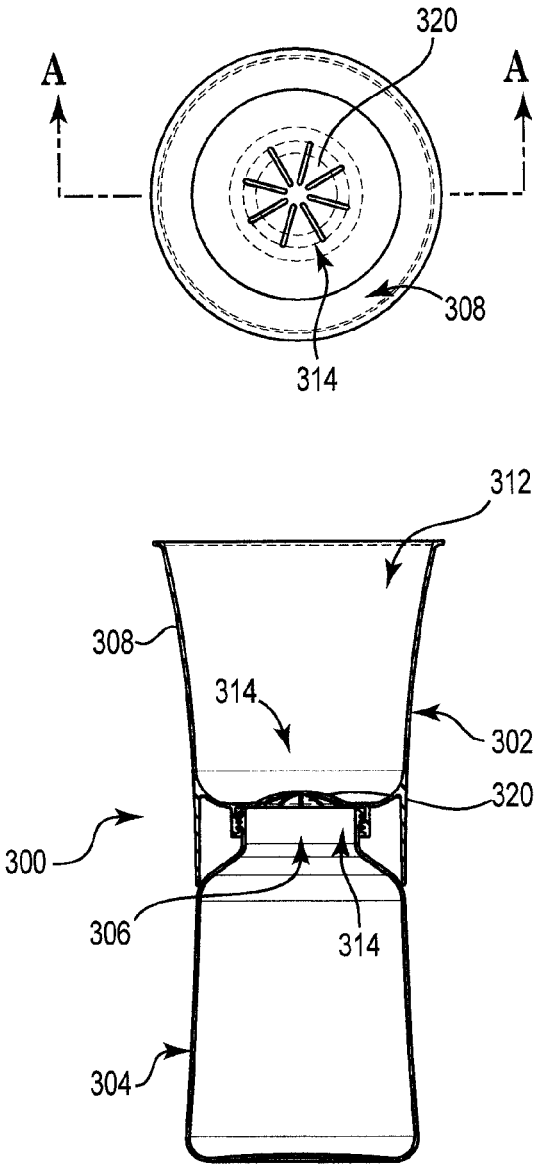
FIG. 5A includes top, side, and side cut-away views of a package as described.

Another embodiment of a combined cereal and milk package is illustrated at FIG. 5A, designated "Milk Container Adaptable Embodiment C." Features of Milk Container Adaptable Embodiment C can include a package that can be stored and offered for sale while containing dry cereal and milk for consumption, each in a separate container. The milk may be refrigerator-stable or shelf stable milk. During use the upper container, containing dry cereal, is removed from the lower container (milk chug). A cover such as a foil that covers and seals an opening in the lower container is removed. A valve can cover a lower opening of the upper container at a location where the lower opening attaches to an upper opening of the lower container; the valve can include a mechanical screen that allows milk to flow through the valve but does not allow passage of pieces of cereal. A removable cover can cover and seal an upper opening of the upper container. After the cover is removed from the lower container opening, the upper container can be replaced on the lower container opening with the valve now separating the interior space of the upper container from the interior space of the lower container, at the location where the lower opening of the upper container is attached to the opening of the lower container. The valve allows milk to pass from the lower container into the upper container, when the package is tipped. The removable cover or cap located at an upper opening of the upper container can be removed and the user can consume the mixture of milk and cereal from the package by tipping the package to deliver the cereal and milk directly to the consumer's mouth, from the opening in the upper container. The valve that separates the upper container from the lower container allows milk to pass back into the lower container but keeps cereal in the upper container to maintain separation of the milk and cereal, preventing the cereal from becoming soggy.

Referring to FIG. 5A, package 300 includes upper container 302 and lower container 304. Upper container 302 can contain dry cereal for storage, marketing, transport, and sale to a consumer. Upper container 302 includes upper opening 312, sidewalls 308, bottom opening 314 (below valve 320), an optional cover (not shown) that covers upper opening 312 except for an opening to access the interior of upper container 302. Valve 320 is located within opening 314 of upper container 302, and allows liquids (e.g., milk) to pass through in either direction, but does not allow cereal pieces to pass from upper container 302 into lower container 304.

Lower container 304 includes opening 306, optionally covered and sealed by a removable (e.g., peelable) cover (not shown) that may be made of plastic, paper, or foil, and that can be secured to opening 306 of lower container 304, e.g., by adhesive. Lower container 304 can contain milk, which can be refrigerated or shelf stable, for storage, marketing, transport, and sale to a consumer.

Opening 314 of upper container 302 engages opening 306 of lower container 304 in a sealing engagement that is tight to liquids, for example by a threaded engagement or a snap fit. After an optional cover is removed to uncover opening 306 of lower container 304, and upper container 302 is re-attached to lower container 304, package 300 contains milk in lower container 304 and dry cereal in upper container 302, with the milk and dry cereal being separated by valve 320, which has openings that allow milk to flow between the two containers but that do not allow cereal pieces to pass from upper container 302 into lower container 304. To dispense a mixture of cereal and milk, a user tips package 300 to cause milk to flow from lower container 304, through upper container 302 and out of opening 311, which also causes cereal to flow from upper container 302 out of opening 311; the mixture of cereal and milk can be dispensed from opening 311, e.g., directly to a user's mouth.

Figure 5B:
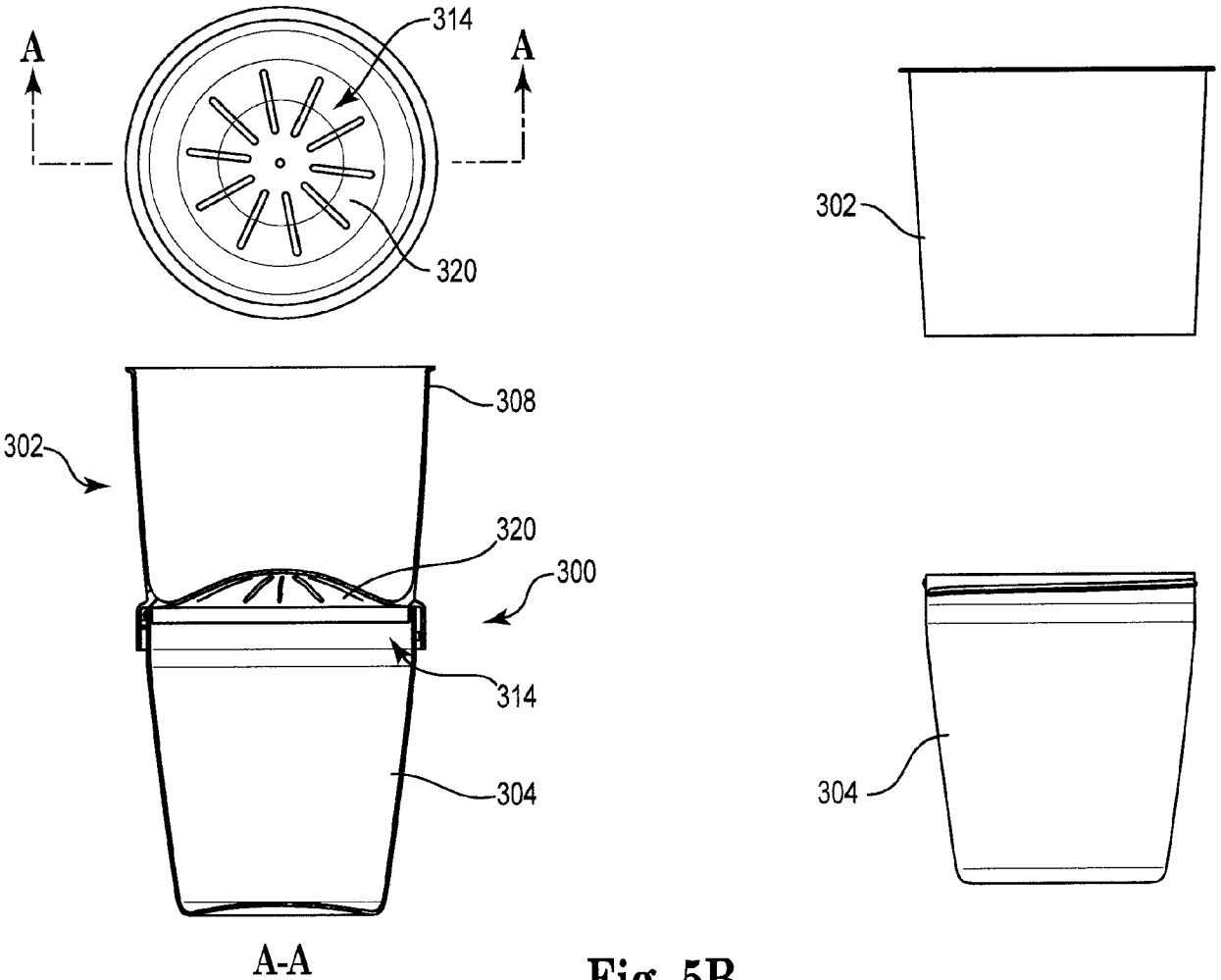
FIG. 5B includes top, side, and side cut-away views of a package as described.

See also FIG. 5B.

"Cereal Ball"

Figure 6:
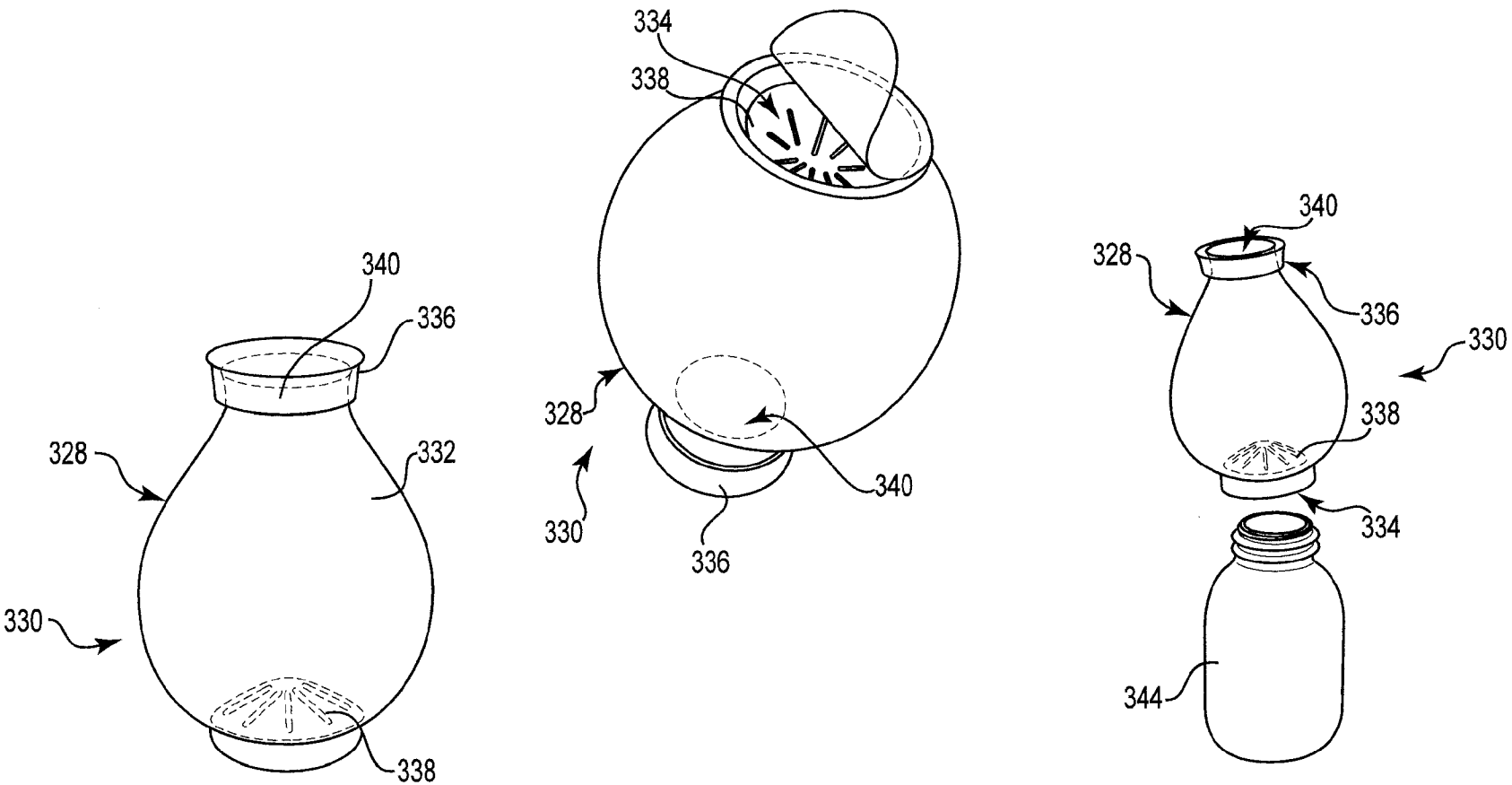
FIG. 6 illustrates various views of a package as described.

FIG. 6 illustrates a concept that involves the manufacture, marketing, packaging, and sale, of a cereal packaged without milk, but with the package being adapted to accept a milk chug that could be purchased separately or in combination with the cereal package. As shown at FIG. 6, the "cereal ball" package includes an upper container of a milk and cereal package that would be similar to package 300, including upper and lower openings and a valve at the lower opening that allows flow of a liquid (milk) through the valve in either direction but does not allow cereal pieces to pass. In use, a cover can be removed from the lower opening of the package and the lower opening can be engaged with a milk chug of a standardized size (e.g., diameter) and threading. A top cover can be removed from the upper opening of the package and a mixture of milk and cereal can be delivered from the upper opening by tipping the package. Milk flows from the lower container, through the upper container and is delivered to a user's mouth in combination with cereal from the upper container. Milk that does not reach the upper opening will flow back through the valve into the lower container.

Referring to FIG. 6, cereal package 330 includes cereal container 332 for containing dry cereal for storage, marketing, transport, and sale to a consumer. Package 330 includes upper opening 340, sidewalls 328, bottom opening 334, and cover 336 that covers upper opening 340. Cover 336 is secured to cereal container 332 around a rim at upper opening 340 by threads, and can be threaded and unthreaded (removed and replaced). Valve 338 is located within bottom opening 334 of container 332, and allows liquids (e.g., milk) to pass through in either direction, but does not allow cereal pieces to pass.

A lower container, 344, can be attached to bottom opening 334, e.g., by threads. Lower container 304 can contain milk, which can be refrigerated or shelf stable, for storage, marketing, transport, and sale to a consumer. When attached, opening 346 of lower container 344 engages bottom opening 334 in a sealing engagement. Container 332 is shaped to have convex sidewalls (328) to facilitate flow of cereal, milk, and wetted cereal, along sidewalls 328 without the wetted cereal sticking to the sidewalls. After cover 336 is removed to uncover opening 340 of container 330, lower container 344 contains milk, and container 332 contains dry cereal, the milk and cereal being separated by valve 338, which has openings that allow milk to flow between the two containers but that do not allow cereal pieces to pass from container 332 into container 344. To dispense a mixture of cereal and milk, a user tips the connected containers to cause milk to flow from container 344, through container 332 and out of opening 340, which also causes cereal to flow from container 332 out of opening 340; the mixture of cereal and milk can be dispensed from opening 340, e.g., directly to a user's mouth.

The cereal and milk packages described herein also include embodiments that can be stored or sold to include a single serving of cereal to be consumed with a single serving of milk, that can be portable and that can be used for eating cereal and milk using a traditional method of eating the cereal and milk using a spoon. In general, these embodiments of combined cereal and milk packages involve two containers, one for milk and one for cereal. The two containers may optionally be attached to each other and one or the other may optionally, additionally, include a spoon, napkin, or both, for use in consuming the milk and cereal. The two packages can be sized and shaped for convenient shipping together and can include features that facilitate use by eating using a spoon. An advantage of these types of combined cereal and milk package is easy transport of a serving of cereal and milk, to allow the user to take a serving from their home or to purchase the serving from a vendor, vending machine, convenience store, fast food outlet, restaurant, etc., to eat the cereal and milk in a location other than a conventional breakfast eating location, e.g., at an office or other location outside of a home or kitchen.

Figure 7:
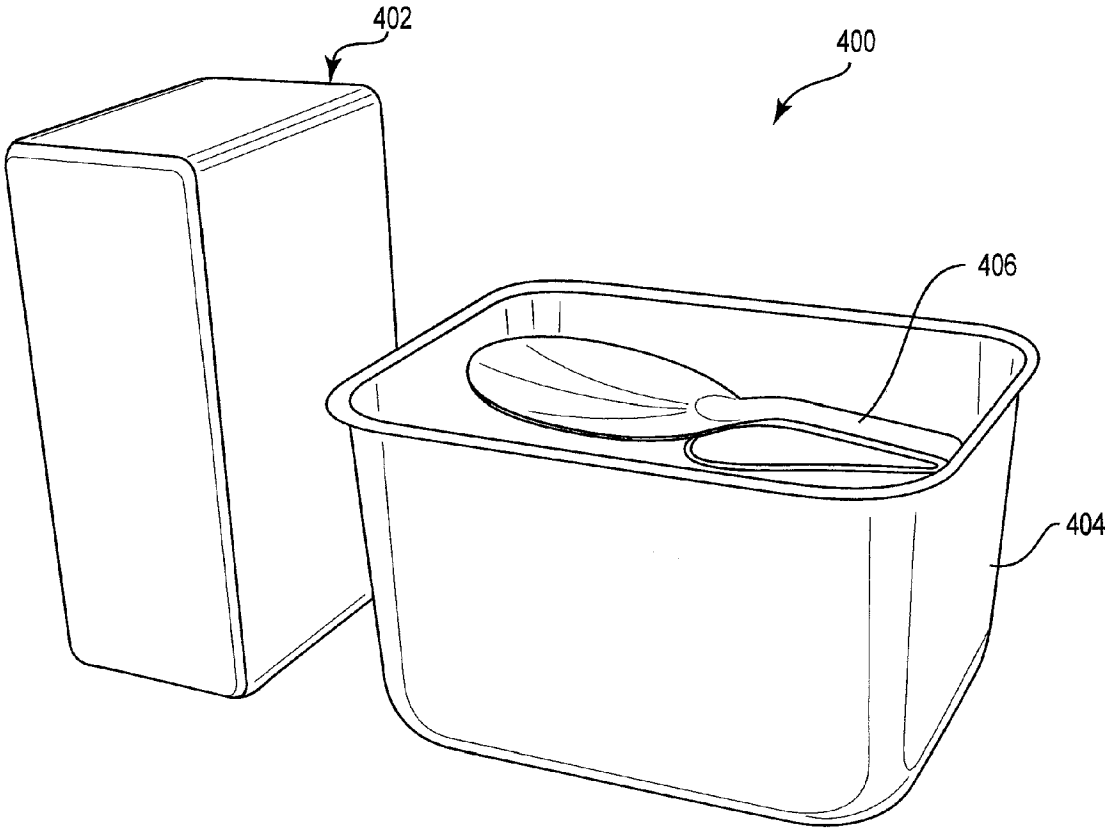
FIG. 7 illustrates a side perspective view of packages as described.

Referring to FIG. 7, combined milk and cereal package kit 400 includes milk package 402, containing milk; cereal package 404, containing dry cereal; a cover (not shown) for cereal package 404; and optional spoon 406 (shown as a foldable spoon). Milk package 402 and cereal package 404 are detached but could be attached in some form or contained together in a larger package. Spoon 406 is shown to be packaged inside of cereal package 404, but could also be within a larger package that contains milk package 402 along with cereal package 404. Milk package 402 can be a cardboard or plastic box or carton sealed for stable refrigerated or shelf-stable (ambient temperature) storage. Cereal package 404 can be a cardboard or plastic container that includes a bottom, sides, and an open top that can be covered (not shown) for storage and shipment. During use, the cover can be removed from cereal package 404, and the milk package 402 can be opened. Spoon 406 can be removed and milk from milk package 404 can be poured over the cereal in cereal package 402. The cereal and milk can be eaten using the spoon.

Figure 8:
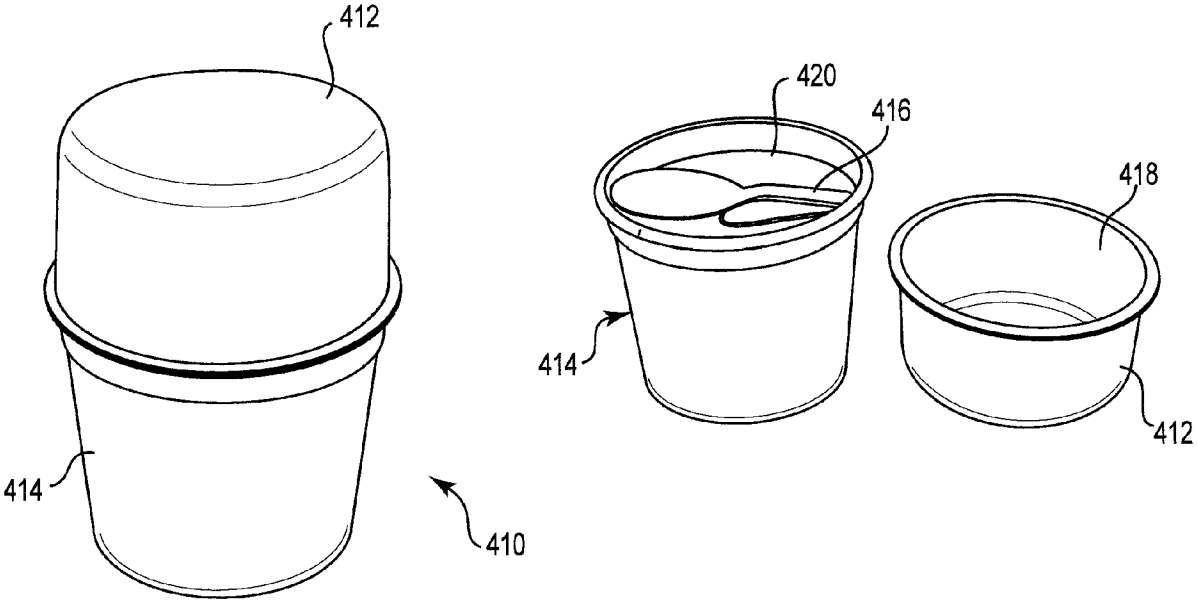
FIG. 8 illustrates a side perspective view of packages as described.

FIG. 8 illustrates another embodiment of portable cereal and milk package that can be used for eating cereal and milk conventionally, using a spoon. Combined milk and cereal package kit 410 includes upper container 412, containing milk; lower container 414, containing dry cereal (and optional spoon 416, illustrated to be foldable). Upper container 412 also functions as a cover for lower package 414. Upper container 412 and lower container 414 are configured to be attachable by upper container 412 being placed securely on top of lower container 414. Upper container 412 can on rest on a flange or widened rim of lower container 414 so that upper container 412 is supported and secured. Alternate modes of securing upper container 412 above lower container 414 may include a snap-fit mechanism, a threaded engagement between opposing surfaces of the two containers, adhesive, paper or plastic tape, or shrink wrapping at a seam between the two packages. Milk can be contained in upper container 412 by placing the milk directly in upper container 412 and placing a seal (e.g., foil or plastic) over opening 418. Alternately, a container of milk such as a pouch, bag, or carton, can be placed in the upper container. The upper container can then be placed above and secured to lower container 414 to cover opening 420.

During use, upper container 412 can be removed from lower container 414, which exposes opening 420 to allow access to cereal (and optional spoon 416) within lower container 414. Upper container 412 (or a milk pouch, bag, or carton therein) can be opened, and milk can be emptied into lower package 414 to mix with cereal contained in lower package 414. Spoon 416 can be used to eat the mixture of milk and cereal from lower package 414.

Figure 9:
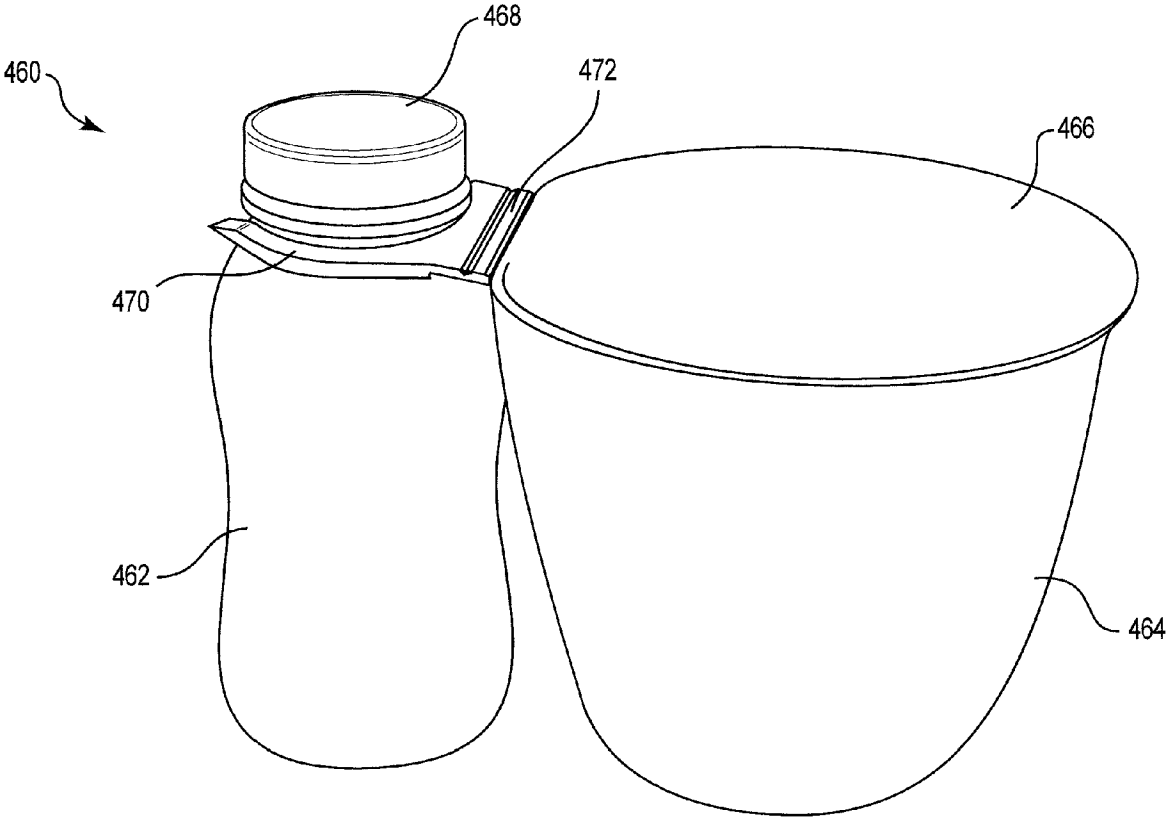
FIG. 9 illustrates a side perspective view of packages as described.

FIG. 9 illustrates another embodiment of portable cereal and milk package that can be used for eating cereal and milk conventionally, using a spoon. Combined milk and cereal package kit 460 includes milk container 462, containing milk, and cereal container 464, containing dry cereal (and an optional spoon, optional napkin, or both, not shown). Milk container 462 and lower container 464 are situated in a side-by-side configuration and connected together by bracket 470, which engages milk container 462, and which is also connected to cereal container 464 at hinge 472. Milk container 462 is closed and sealed by cover 468 which can be any type of sealing cover, such as a threaded cover. Cereal container 464 is covered and sealed by cover 466, which can be any cover, such as a plastic, paper, cardboard, or foil film secured to a perimeter of cereal container 464 by, e.g., adhesive.

During use, cover 468 can be removed to open milk container 462, and cover 466 can be removed to open cereal container 464. Milk container 462 can be pivoted about hinge 472 to allow milk to be poured from milk container 462 into cereal container 464. A mixture of milk and cereal can be eaten from cereal container 464.

FIGS. 10A, 10B, 10C, and 10D illustrate a package that includes a container for containing cereal (e.g., an "upper container"), which may be attached to a lower container containing milk. Package 564 includes an upper container piece 560 and cover piece 562 comprising cover 563, perimeter 566, and cover opening 574. The three-dimensional form of cover piece 562 forms coverspace 565 located above upper container interior space 576, allowing communication between upper container interior space 576 and holding stage 586.

Upper container interior space 576, for containing cereal, is defined by bottom 578, back and side sidewalls 580 and front sidewall 582, and at an upper opening communicates with coverspace 565. Front sidewall 582 is slanted toward the front of the container; sidewall 582 is closer to the front at upper regions of the sidewall and is farther from the front at lower regions and at bottom 578. An example of the magnitude of the slant can be in the range from between 0 to 25 degrees when the upper container is held in a vertical direction, with perimeter 68 being in a horizontal plane.

Holding stage 586 is defined on a bottom by stage 587, at a back side by backwall 588, and on a front side by a front interior surface of cover 563, and is in communication above with coverspace 565, cover opening 574, and with upper container interior space 576 by way of cereal passage 590. Below holding stage 586 is milk channel 584, defined on a front side by extension sidewall 572 and on a back side by sidewall 582. Milk ports (illustrated but not numbered) in stage 587 allow milk to flow between milk channel 584 and holding stage 586.

Upper perimeter 570 at an upper region of upper container piece 560 includes an engagement element that engages an opposing engagement element of perimeter 566 of cover piece 562 to form liquid-tight engagement 592 around opposing perimeters 570 and 566. The engagement may be any useful liquid-tight engagement and as shown is a beveled shoulder at a perimeter 570, contacting an opposing structure at perimeter 566. The shoulder and opposing structure are made of material that allows the outer perimeter 566 to snap onto the beveled shoulder perimeter to produce liquid-tight engagement 592 between the two perimeters. Alternate engagements could also be used such as threaded engagements, a snap-fitting ridge and opposing outer ring structure, opposing mechanical detents, etc.

Upper container piece 560 also includes extension sidewall 572 extending from perimeter 570 of the upper container, at a location around and outside of the sidewall 580 and milk channel 584, extending toward and to a lower region of container 560. Perimeter 568 at a lower region of extension sidewall 572 includes an engagement element useful to attach a lower region of upper container 560 to an upper region of a lower container in a liquid-tight manner. As illustrated the engagement element at perimeter 568 is a snap-fit annular rounded ridge, but other types of engagement elements an be used.

Bottom 578 is located at or above perimeter 568 and the engagement element of perimeter 568. In alternate embodiments perimeter 568 may be above or below bottom 578 (e.g., extension sidewall 572 may be longer or shorter, extending to a different location relative to bottom 578) and the engagement element of perimeter 568 can be located differently in a corresponding manner.

Perimeter 568 defines bottom opening 596 that, when upper container 560 is engaged with a lower container at perimeter 568, allows fluid communication between the upper container and the lower container. Milk channel 584 is in communication with the lower container when attached at perimeter 568. For packaging and sale of package 564 (containing cereal at interior space 576) separate from a milk container, bottom opening 596 can be covered and sealed, e.g., by a foil, paper, plastic sheet, etc., e.g., by us of adhesive around perimeter 568; the cover and seal can be removed by a consumer immediately before attaching upper container piece 560 to a lower container that contains milk.

Figure 10B:
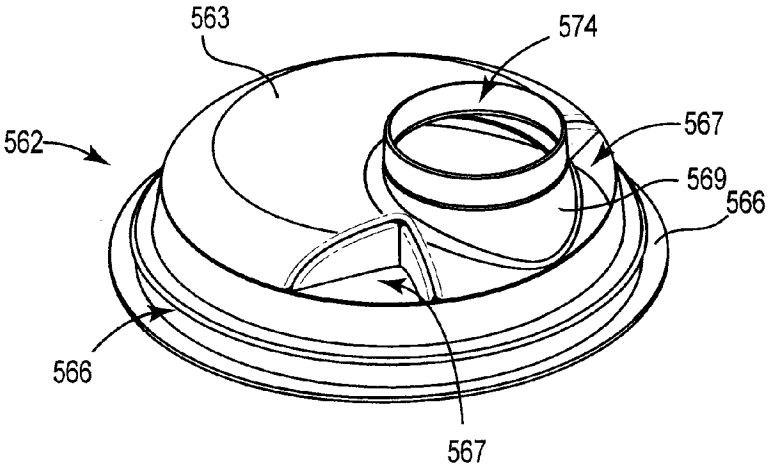
FIG. 10B illustrates a top perspective view of a piece of a package as described.
Figure 10A:
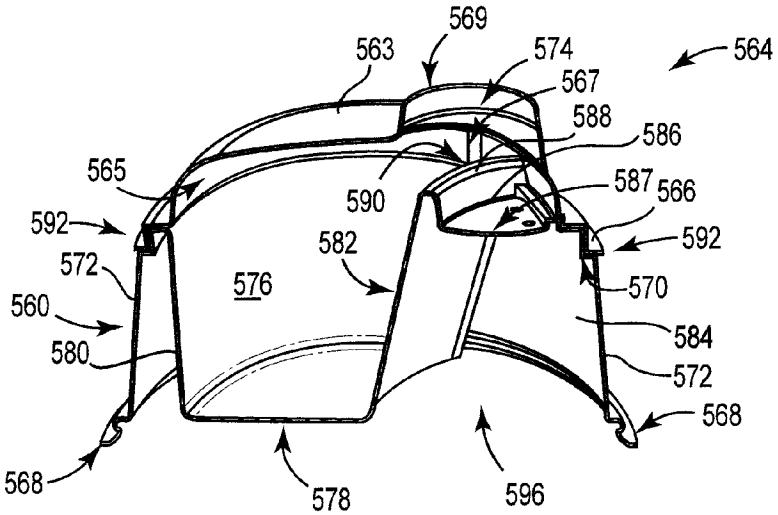
FIG. 10A illustrates a side perspective cut-away view of a package as described.

As shown at FIG. 10B, cover piece 562 can include a vertical mouthpiece 569 extending generally upward from cover 563 to define cover opening 574. Mouthpiece 569 can facilitate dispensing milk and cereal to a mouth of a user. Also at FIG. 10B are shown optional indents 567 that protrude inward from cover 563 into coverspace 565 at a front region of cover 563, on opposing sides of mouthpiece 569. Indents 567 can optionally be included in cover 563 to partially define boundaries of a holding stage, cereal channel, or coverspace, e.g., to direct flow of cereal from an upper container interior space to a holding stage or to a cover opening. FIG. 10A points out interior surfaces of indents 567 in relation to cover piece 567 and features at the front thereof. Cover piece 563 illustrated at FIG. 10D does not include indents, which are optional.

Figure 10C:
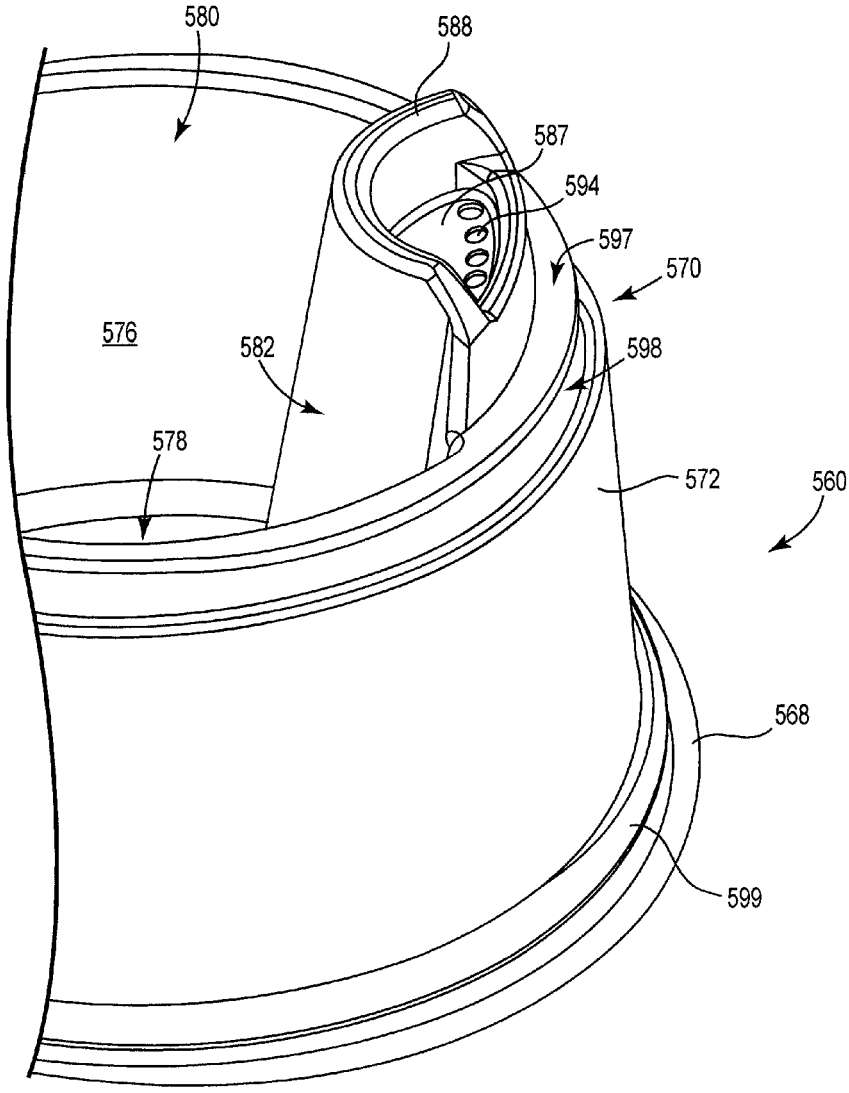
FIG. 10C illustrates a side perspective view of a package as described.

FIG. 10C is a detailed view of upper container piece 560 showing features as described, further showing details of milk ports 594, the beveled shoulder engagement element at perimeter 570, and snap-fitting rounded ridge engagement element 599 at lower perimeter 568. The beveled shoulder includes horizontal shoulder surface 597, which as illustrated is substantially horizontal when upper container piece 560 is held vertically, and beveled shoulder surface 589. Beveled shoulder surface 589 extends around perimeter 568 in a generally planar ring manner as a surface that is substantially vertical when upper container piece 560 is held vertically; surface 598 can be slightly slanted from vertical, i.e., beveled, so the diameter of the ring at the upper region of surface 598 (connected to horizontal surface 597) is slightly larger than the diameter of the ring lower levels. An example of an angle of the bevel may be, e.g. from about 0 to 15 degrees from vertical. The larger diameter at the top allows a corresponding engagement element on a perimeter of a cover piece to be snapped over the beveled shoulder to produce a liquid-tight engagement.

Figure 10D:
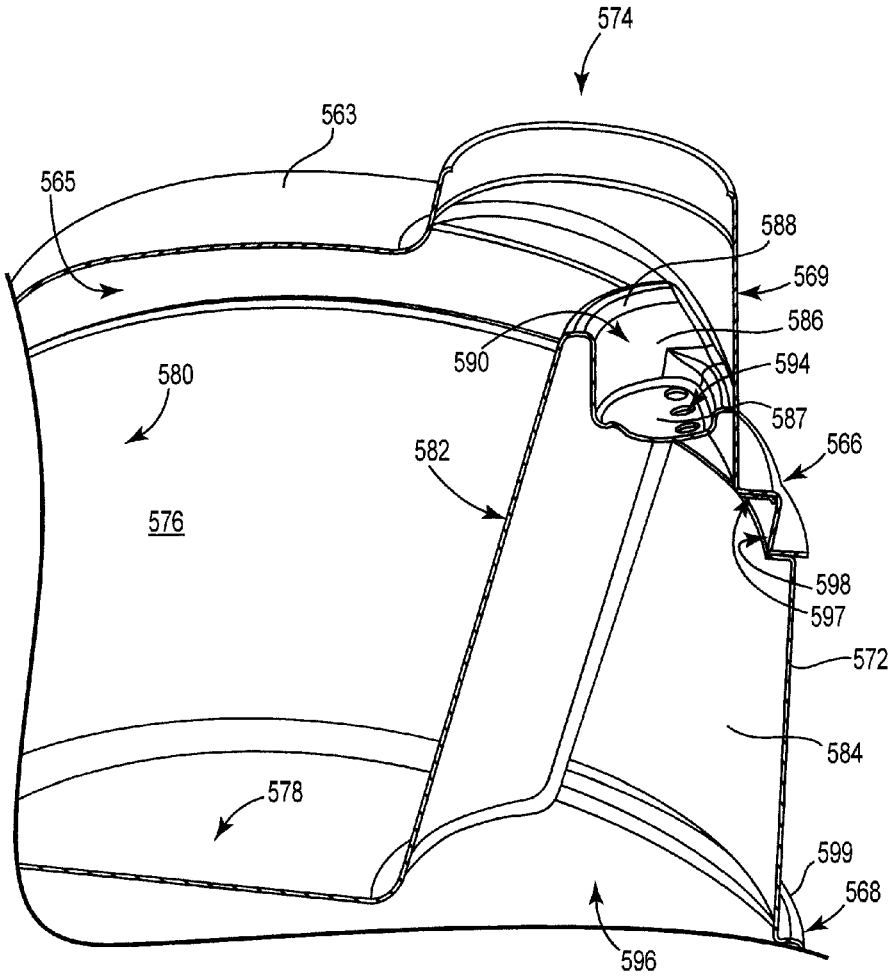
FIG. 10D illustrates a side perspective cut-away view of a package as described.

FIG. 10D is a detailed view of upper container piece 560, engaged with cover piece 562.

Figure 11A:
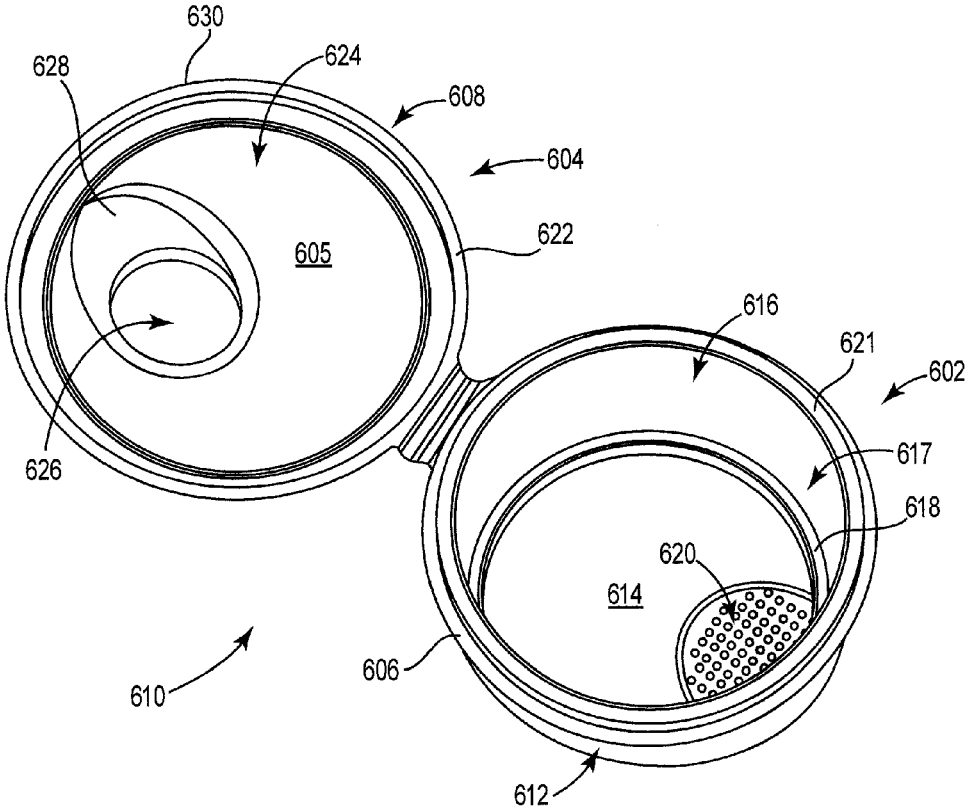
FIG. 11A illustrates a top perspective view of a package as described.
Figure 11D:
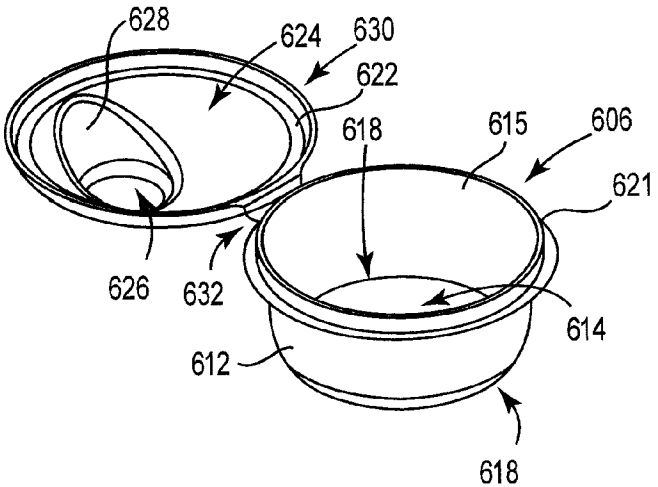
FIG. 11D illustrates a top perspective view of a package as described.
Figure 11B:
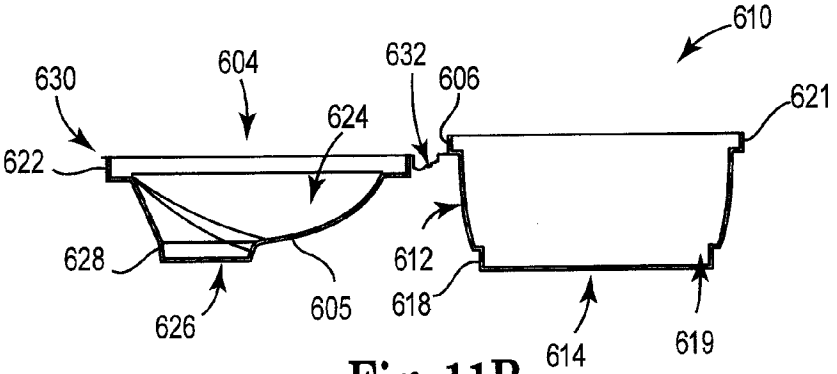
FIG. 11B illustrates a side cut-away view of a package as described.
Figure 11C:
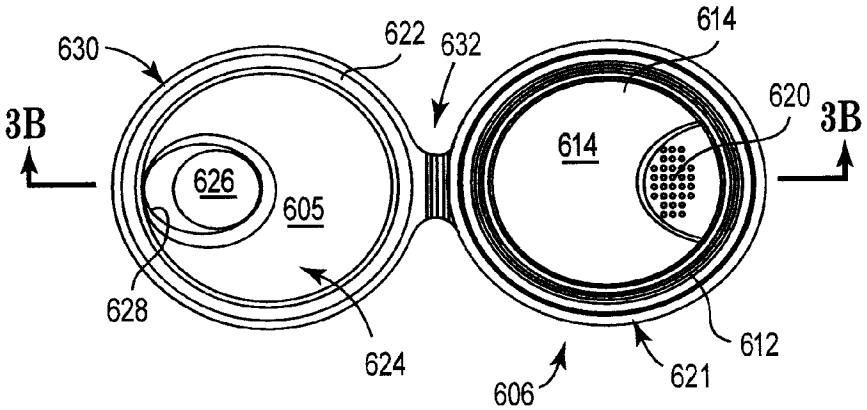
FIG. 11C illustrates a top view of a package as described.

FIGS. 11A, 11B, 11C, and 11D illustrate an embodiment of a package as generally described. Referring to FIG. 11A, package 610 includes a first container piece 602 for containing a dry food (e.g., cereal), also sometimes referred to as an "upper container piece" when engaged at a location above a "lower" milk container. Package 610 also include cover piece 604.

First container piece 602 and cover piece 604 are separate pieces that engage in a liquid tight manner at perimeters 606 and 608 of first container piece 602 and cover piece 604, respectively. The structures of these pieces embody two separate pieces of a container (610) that can be attached and separated, but according to other embodiments may be part of an integral, single piece container. Optional hinge 632 connects the pieces.

First container piece 602 includes sidewalls 612, bottom 614, container inner space 616, and perimeter 606 at an upper region of container piece 602 including engagement element 621. Interior space 616 can be considered to be defined on sides by sidewalls 612, on a bottom by bottom 614, and on top by aperture 615 bounded by a perimeter of an upper region of sidewalls 612. Bottom 614 includes front apertures 620 which allow for fluid (e.g., milk) passage between interior space 616 and a space below. At a lower region of container 610 is lower engagement element 618, as illustrated, in the form of a shoulder.

Cover piece 604 includes cover, coverspace 624, cover opening 626, mouthpiece 628, and perimeter 630 that includes engagement element 622 that engages opposing engagement element 621 in a liquid-tight manner.

A feature of the multi-piece package illustrated at FIGS. 11A through 11D is that the upper container interior space does not extend into a lower container interior space, when placed above a lower container. According to alternate package embodiments, sidewalls or a bottom that define an upper container interior space may be located within the lower container interior space when the upper container piece is engaged above a lower container piece.

Figure 12B:
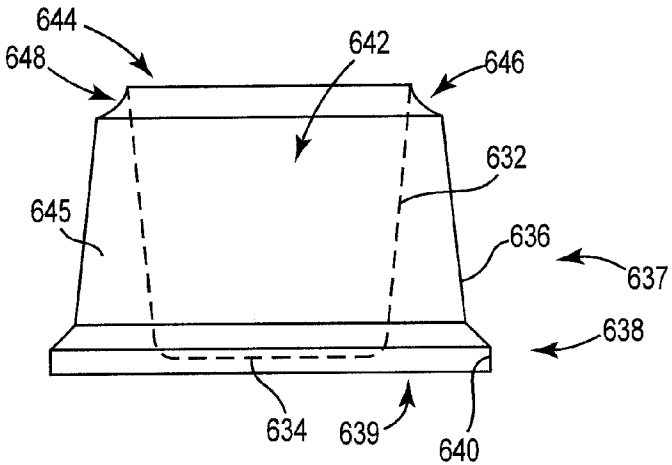
FIG. 12B illustrates a side view of a package as described.
Figure 12A:
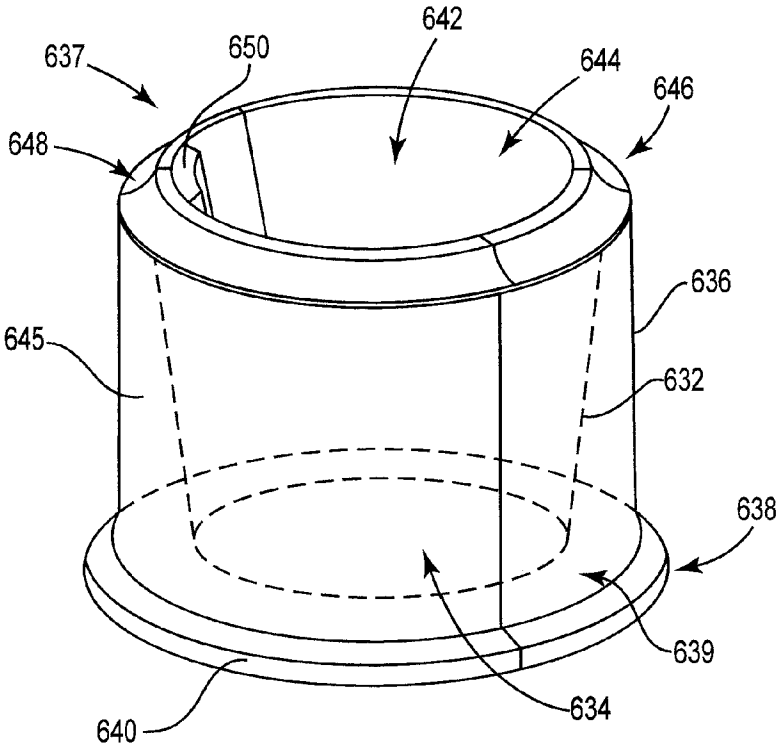
FIG. 12A illustrates a side perspective view of a package as described.

FIGS. 12A, 12B, 12C, and 12D illustrate an embodiment of a container or container piece as generally described, having an interior space for containing dry food such as cereal (e.g., an upper container interior space). Referring to FIG. 12A, container piece 637 is useful as a container for containing dry food such as cereal. Container piece 637 can also sometimes be referred to as an "upper container piece" when engaged at a location above a "lower" milk container. Perimeter 646 at an upper region of container piece 637 includes engagement element 648, illustrated to be a shoulder structure but optionally another engagement element. Interior space 642 can be considered to be defined on sides by inner sidewalls 632, on a bottom by bottom 634, and on top by aperture 644 bounded by an upper region of sidewalls 632.

Container piece 637 also includes extension sidewalls 636 extending from perimeter 646 in a generally downward direction to lower perimeter 638, which includes engagement element 640 in the form of a generally planar ring that allows a snap-fit engagement with a rounded or otherwise correspondingly shaped rim of a lower container such as a plastic cup or glass. Perimeter 638 also defines lower opening 639.

Channel space 645 is defined between inner sidewalls 632 and extension sidewalls 636. In the embodiment of FIGS. 12A and 12B, channel space 645 is in fluid communication with milk port 650 (see FIG. 12A) located at an upper region of sidewalls 632 and 636, and at a front perimeter of an upper region of interior space 642. In this embodiment, bottom 634 does not include a front aperture to allow a front side of interior space 642 to communicate with a lower container interior space when container piece 637 is engaged above a lower container, e.g., for milk to flow from a lower container interior space into interior space 642 when package piece 640 is tipped forward. Instead, milk can flow from a lower container interior space, through a front side of aperture 639, through channel space 645, and through milk port 650, directly into a user's mouth without passing through interior space 642, the milk avoiding contact with cereal located inside of interior space 642.

Figure 12C:
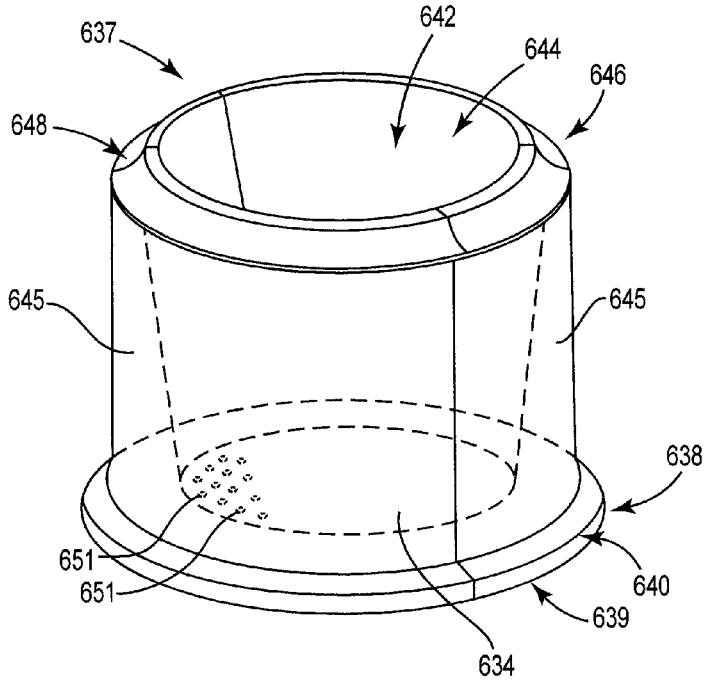
FIG. 12C illustrates a side perspective view of a package as described.

FIG. 12C shows a slight variation on the piece of FIG. 12A: front apertures 651 are included in bottom 634, and milk port 650 has been removed. In this embodiment, when package piece is tipped forward, milk can flow from a lower container interior space, through a front side of aperture 639 and through front apertures 651, passing through interior space 642 and contacting cereal located inside of interior space 642, then through aperture 644 and into a user's mouth.

FIGS. 12A, 12B, and 12C do not show a cover piece or a cover. An optional cover or cover piece (optionally including a three-dimensional cover that defines a coverspace (a volume below the cover)), or alternately flat (planar, two-dimensional, and not three-dimensional) could be included in combination with container piece 637, e.g., to cover interior space 642, optionally by connecting to perimeter 646, e.g., by a liquid-tight engagement at engagement element 648.

Figure 12D:
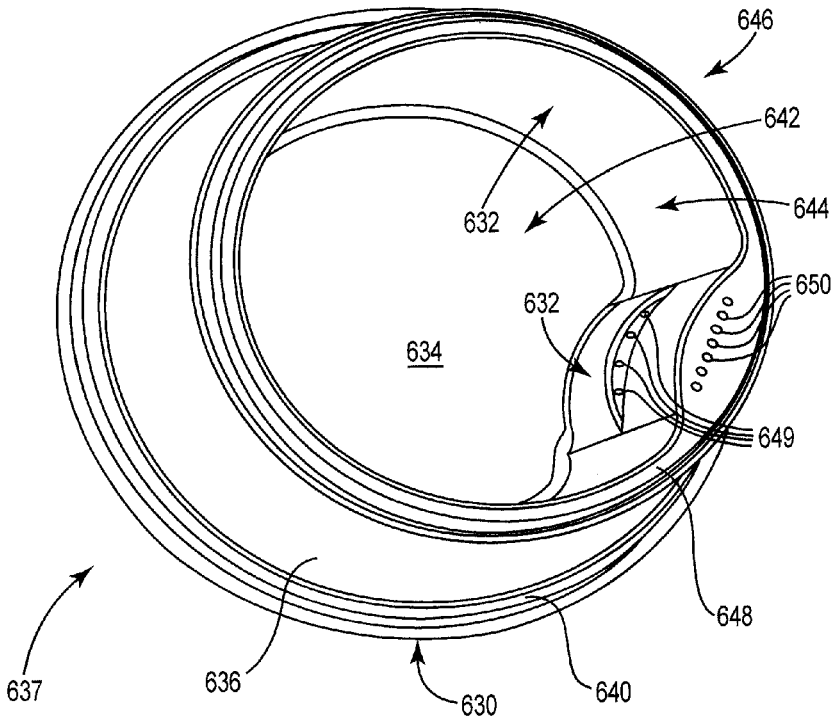
FIG. 12D illustrates a top perspective view of a package as described.

FIG. 12D shows a variation on the piece of FIG. 12A or 12B: milk port 650 at an upper region of channel space 645 is still present, and additional milk ports 649 are added at a middle region of interior space 642 and channel space 645. Milk ports 649 are apertures in a front side of sidewall 632 that connect channel space 645 to interior space 642 so milk can flow from channel space 645 to interior space 642 during use (tipping and un-tipping back to vertical. In this embodiment, when package piece 640 is tipped forward, milk can flow from a lower container interior space below container piece 637, through a front side of aperture 639 (at the bottom of container piece 637, but not shown), through milk channel 645 (in front of sidewall 632 at a front of interior space 642) and through milk ports 649 and 650, eventually being dispensed with cereal from interior space 642 into a user's mouth. Engagement element 640 can be designed to snap fit onto a standard plastic drinking glass or cup.

A feature of the multi-piece packages illustrated at FIGS. 12A through 12D is that the upper container interior space does not extend into a lower container interior space, when placed above a lower container. According to alternate package embodiments, sidewalls or a bottom that define an upper container interior space may be located within the lower container interior space when the upper container piece is engaged above a lower container piece.

Any of the above package configurations can be used with any type of particulate food as a dry cereal. Dry cereals are well known and examples of useful cereals include any breakfast (a.k.a. "ready-to-eat" cereals) available as particulates, flakes, etc., produced from known food ingredients such as wheat grain, corn, rice, oats, barley, triticale, and the like, optionally including additional ingredients such as salt, minerals, protein, sugar fiber (e.g., bran, cellulose, pectin), vitamins, flavorants, colorants, etc.

The milk may be of the type generally stored at refrigerated temperatures, or at ambient (e.g., "shelf stable," "extended shelf life" or "ultra-pasteurized" milk) conditions.

The amounts of each of the cereal and milk contained in a combined cereal and milk package can be any amount, and in particular can be an amount suitable for a single serving for one individual, e.g., about ¾ cup (or about 6 ounces) of cereal and about 8 ounces of milk.

The materials of the package and containers thereof can be any packaging material currently available or designed in the future, including, for example, glass, paper, cardboard, and polymeric materials known for use in these applications. A glass or polymeric material may be see-through (transparent, clear, colored, shaded), opaque, translucent, colored, etc.

Materials may be thermoplastic or thermoformed, or may be coated paper or cardboard, or combinations of these in multiple layers. In preferred embodiments an internal sidewall surface can be made of or coated to exhibit a of a low surface energy, e.g., a surface energy below about 50 dynes per centimeter, or less than 40 or 38 dynes per centimeter. Exemplary low surface area materials include polystyrene, polyvinylalcohol (PVA) polyethylene, polypropylene, and the like.

Following are exemplary embodiments that are not intended to limit the foregoing description.

In one embodiment, a combined cereal and milk package includes a milk container that contains milk and a cereal container that contains dry cereal, including one or more of the following features:

- Upon tipping the package, milk and cereal can flow separately into a cereal holding stage near an opening at the top of the package, where the milk contacts the cereal and the milk and cereal can be delivered through the opening to a consumer,
- The milk container can be located in a position below the cereal container and a cereal container can contain a milk channel that leads milk from the milk container to the cereal holding stage,
- A cereal holding stage can include an upper end of the milk tunnel in the form of a milk port that is of a size to regulate the flow of milk from the milk tunnel into the cereal holding stage.

In another embodiment a combined milk and cereal container includes a milk container and a cereal container:

- The milk container can be on a bottom portion of the package and attached directly to the cereal container, located above the milk container,
- The top of the milk container may engage the bottom of the cereal container by any secure mechanical engagement, such as by a threaded engagement or a snap-fit engagement,
- An opening of the milk container that engages the cereal container can have a seal,
- An opening of the cereal container that engages the milk container can have a cover that can be broken or dissolved (and that is edible),
- After unsealing the milk container, the cereal container can be re-attached to the milk container and shaken to open the cereal container and allow the cereal to be dispensed into the milk container,
- The cereal container may be removed and milk and cereal can be delivered to a consumer directly from the milk container.

In another embodiment a combined milk and cereal container includes a milk container and a cereal container:

- The milk container can be on a bottom portion of the package and attached directly to the cereal container, located above the milk container,
- The top of the milk container may engage the bottom of the cereal container by any secure mechanical engagement, such as by a threaded engagement or a snap-fit engagement,
- An opening of the milk container that engages the cereal container can have a seal,
- An opening of the cereal container that engages the milk container can have a cover that can be broken or dissolved (and that is edible),
- The cereal container can include a second ("upper") opening through which a mixture of cereal and milk can be dispensed after milk and cereal are combined within the package,
- After unsealing the milk container, the cereal container can be re-attached to the milk container and shaken to break or dissolve the cereal container cover and open the cereal container, allowing cereal to transfer from the cereal container to the milk container,
- Milk and cereal can be delivered to a consumer from the upper opening at the top of the cereal container while the cereal container is engaged with the milk container.

In another embodiment a combined milk and cereal container includes a milk container and a cereal container:

- The milk container can be on a bottom portion of the package and attached directly to the cereal container, located above the milk container,
- The top of the milk container may engage the bottom of the cereal container by any secure mechanical engagement, such as by a snap-fit engagement or a threaded engagement, e.g., a standardized threaded engagement,
- An opening of the milk container that engages the cereal container can have a seal,
- The cereal container can include a second ("upper") opening through which a mixture of cereal and milk can be dispensed after milk and cereal are combined within the package, e.g., in the cereal container,
- An opening between the cereal container and the milk container can includes a "screen" (or "filter") that allows milk to flow from the milk container into the cereal container, or from the cereal container into the milk container, but does not allow cereal to pass from the cereal container to the milk container,
- After unsealing the milk container, the cereal container can be re-attached to the milk container,
- Milk and cereal can be delivered to a consumer from the upper opening at the top of the cereal container while the cereal container is engaged with the milk container,
- The cereal and milk containers may be packaged or sold together in combination, e.g., as a kit, or separately.

In another embodiment, a kit that includes separate milk and cereal containers can include:

- A milk container comprising a plastic, paper, or cardboard carton or box,
- A cereal container containing cereal, optionally an eating implement such as a spoon, and optionally a napkin,
- The cereal container can be sealed by a paper, cardboard, or foil layer that is secured to an opening on the cereal container and that can be peeled away to open the cereal container,
- Milk can be poured into the cereal container and consumed using the spoon.

In another embodiment, a kit that includes separate milk and cereal containers can include:

- A milk container comprising a plastic, paper, or cardboard carton or box,
- A cereal container containing cereal, optionally an eating implement such as a spoon, and optionally a napkin,
- A bottom of the milk container fit and engage the top of the cereal container to allow a "stacked" configuration,
- The cereal container can be sealed by a paper, cardboard, or foil layer that is secured to an opening on the cereal container and that can be peeled away to open the cereal container,
- After removing the milk container from above the cereal container and opening the milk container, milk can be poured into the cereal container and consumed using the spoon.

In another embodiment, a kit that includes separate milk and cereal containers can include:

- A milk container in the form of a plastic bottle,
- A cereal container containing cereal, optionally an eating implement such as a spoon, and optionally a napkin,
- A bracket and hinge that engage the milk container and the cereal container so that the milk container can be opened and the cereal container can be opened, and the milk bottle can be pivoted at the hinge to pour milk into the cereal container, Milk and cereal can then be eaten from the cereal container.

The invention claimed is:

1. A multi-container package comprising:

a lower container comprising a lower container interior space defined by a bottom and sidewalls, wherein the sidewalls have an upper edge; and an upper container connected to the lower container above the upper edge of the sidewalls of the lower container, and in communication with the lower container interior space, the upper container comprising:

an upper container interior space comprising an upper container bottom and upper container sidewalls extending upwardly from the upper container bottom, wherein the upper container sidewalls comprise an upper edge and a lower edge, and wherein the upper container bottom extends between the upper container sidewalls at the lower edge of the upper container sidewalls, a fluid channel in fluid communication with the upper and lower container interior spaces and positioned within the upper container interior space, the fluid channel comprising:

a lower edge at the upper container bottom;

a portion of the upper container sidewalls;

an internal channel wall spaced internally from the upper container sidewalls; and a shelf comprising a fluid aperture at an upper edge of the fluid channel, wherein the shelf extends between the upper container sidewall and the internal channel wall at a vertical position that is spaced downwardly from the upper edge of the upper container sidewalls; and a holding stage comprising the shelf and an inner holding stage wall extending upwardly from the shelf within the upper container interior space, wherein the inner holding stage wall comprises at least one side passage in communication with the upper container interior space, and wherein the holding stage is in fluid communication with the lower container interior space through the channel and the aperture in the shelf.

2. A package according to claim 1 wherein the holding stage defines a volume in the range from 0.25 to 1 cubic inches.

3. A package according to claim 1 comprising multiple pieces including a lower container piece comprising the lower container interior space and an upper container piece comprising the upper container interior space.

4. A package according to claim 1 comprising multiple pieces including a lower container piece comprising the lower container interior space defined by the lower container bottom and lower container sidewalls, the lower container bottom extending between the lower container sidewalls at a lower region of the lower container sidewalls, an opening at an upper region of the lower container, and a lower container upper-container engagement at an upper region of the lower container;

an upper container piece comprising the upper container interior space defined by the upper container bottom and sidewalls, and an upper container lower-container-engagement that engages the lower container upper-container engagement in a liquid-tight manner.

5. A package according to claim 4 wherein the upper container piece comprises an extension sidewall extending from a perimeter of the upper container at an upper region of the upper container, toward the lower container and outside of the sidewall defining the upper container interior space, the extension sidewall comprising the upper container lower-container-engagement that engages the lower container upper-container engagement in a liquid-tight manner.

6. A package according to claim 1 wherein the upper container interior space does not extend into the lower container interior space.

7. A package according to claim 1 wherein the upper container contains dry breakfast cereal and the lower container contains milk.

* * * * *